US009175832B2

(12) United States Patent
Sy et al.

(10) Patent No.: US 9,175,832 B2
(45) Date of Patent: Nov. 3, 2015

(54) FACETED LED STREET LAMP LENS

(71) Applicant: Light Engine Limited, Hong Kong (CN)

(72) Inventors: Yuk Tsan Sy, Hong Kong (CN); Wa Hing Leung, Hong Kong (CN)

(73) Assignee: Light Engine Limited, Hong Kong (CN)

( * ) Notice: Subject to any disclaimer, the term of this patent is extended or adjusted under 35 U.S.C. 154(b) by 167 days.

(21) Appl. No.: 14/027,827

(22) Filed: Sep. 16, 2013

(65) Prior Publication Data

US 2015/0078011 A1 Mar. 19, 2015

(51) Int. Cl.

| | |
|---|---|
| ***F21V 5/00*** | (2015.01) |
| ***F21V 13/04*** | (2006.01) |
| ***F21V 7/04*** | (2006.01) |
| ***F21V 5/08*** | (2006.01) |
| *F21W 131/103* | (2006.01) |
| *F21Y 101/02* | (2006.01) |

(52) U.S. Cl.

CPC . *F21V 13/04* (2013.01); *F21V 5/08* (2013.01); *F21V 7/048* (2013.01); *F21W 2131/103* (2013.01); *F21Y 2101/02* (2013.01)

(58) Field of Classification Search

CPC ..... F21V 7/048; F21V 7/09; F21V 5/048; F21V 5/045; F21V 13/04

USPC ..... 362/308, 310, 311.02, 327, 431

See application file for complete search history.

(56) References Cited

U.S. PATENT DOCUMENTS

| | | | | |
|---|---|---|---|---|
| 8,585,239 | B1 * | 11/2013 | Tseng | 362/244 |
| 8,591,074 | B1 * | 11/2013 | Jiang et al. | 362/311.02 |
| 8,820,979 | B2 * | 9/2014 | Lee et al. | 362/311.02 |
| 2004/0189933 | A1 * | 9/2004 | Sun et al. | 351/177 |
| 2009/0225551 | A1 * | 9/2009 | Chang et al. | 362/311.06 |
| 2012/0039077 | A1 * | 2/2012 | Householder | 362/308 |
| 2015/0009683 | A1 * | 1/2015 | Harada | 362/311.06 |

FOREIGN PATENT DOCUMENTS

| | | | |
|---|---|---|---|
| CN | 101651178 | A | 2/2010 |
| CN | 101696784 | A | 4/2010 |
| CN | 201561367 | U | 8/2010 |
| CN | 102287679 | A | 12/2011 |
| WO | WO-2011124615 | A1 | 10/2011 |

OTHER PUBLICATIONS

Jun. 17, 2014 International Search Report for PCT International Application PCT/CN2013/084501.

* cited by examiner

*Primary Examiner* — Peggy Neils
(74) *Attorney, Agent, or Firm* — Schiff Hardin LLP

(57) ABSTRACT

A lens for an LED street lamp has an external curved surface that has a concave surface portion on one side thereof. A back surface of the lens has a micro-prism array and retainer feet. A recess in the back surface receives an LED light source. The outer surface of the lens has facets or windows that provide overlapping projections of light from adjacent facets. The lens is generally cushion shaped with an indentation at one side. The lens directs light in an asymmetrical distribution transverse to the lens and to direct light symmetrically over a wide area in a longitudinal direction of the lens.

16 Claims, 22 Drawing Sheets

FACETED LED STREET LAMP LENS

FIELD OF THE INVENTION

The present invention relates generally to a lens for use in a street lamp, and more particularly to a lens for use with a light emitting diode ("LED") street lamp.

BACKGROUND OF THE INVENTION

LEDs are energy-efficient and environmentally friendly and feature high lighting efficiency and long working life. As such, LEDs have seen more extensive applications lighting installations in general and specifically in road illumination as a new generation of green, energy-efficient light sources. LED street lamps have become a leading choice in the transformation of road lighting for energy conservation. However, from the perspective of illumination. LED street lamps still face technical problems in four areas, namely lighting efficiency, light distribution, light attenuation and color temperature. Considerable improvements have been made in the lighting efficiency, light distribution, and light attenuation of LED street lamps due to rapid developments in LED semiconductor techniques, secondary light distribution technology, and heat-radiating technology.

For example, the various secondary optical lens types such as those having a free-curved-face peanut shape, a saddle shape or an asymmetric curved face for polarization can distribute light emitted by LED into highly-efficient uniform light patches of a rectangular shape. The curved surface for light distribution adopts a bat-wing shape is well adapted to satisfying the design standards of urban road illumination in China.

However, until now there has been no satisfactory solution to the color temperature differences (i.e., color differences) of LED street lamps. The uneven application of fluorescent powders on the light-emitting surface of LED chips and the color differences inherent to the secondary optical lens will normally generate different color temperatures in the middle and at the edges of the projected light patches. The light patches are bluish with a higher color temperature in the middle, but yellowish with a lower color temperature at the edges. In addition, color temperature is an important parameter affecting the performance of LED street lamps, and its spatial distribution is highly significant for product performance.

The relevant color temperature refers to the temperature of a black-body radiator that is most similar to the color of the same brightness stimulus. The relevant color temperature difference distinguishable by the human eye may be as low as 50-100K, compared to up to several hundred K in the differences in the spatial distribution of relevant color temperatures of LED street lamps. The lens with color differences will generate highly distinctive yellow-and-white "optical zebra crossings" on the road surface, and hence severely affect the visual effect of the street lamp.

BRIEF SUMMARY OF THE INVENTION

In consideration of the above, a first aspect of the present invention provides a secondary optical lens of an LED street lamp which integrates an optical lens featuring a free curved surface for oblique light distribution with faceted face technology that provides a light-mixing effect. The street lamp lens distributes the light rays emitted by the LED over a wide-angle along the X-X or longitudinal section of the lens (along the road direction) and over an asymmetrical and oblique angle along the Y-Y or lateral section of the lens (perpendicular to the road direction). The curved surface of the lens that provides light distribution of the lens has many miniature facets thereon that provide a light-mixing function. All light rays that are outputted from each miniature facet have a very small dispersion angle of their own, and they form light patches of uniform color temperature as a result of overlapping of the light patches emitted by nearby facets. This configuration fully solves the color difference problems of LED street lamp light patches, i.e., bluish in the middle and yellowish at the edges of the light patches, eliminates the "optical zebra crossing" on the road surface, and hence ensures the uniform distribution of light patches on the road surface.

Since secondary optical lens according to this first aspect of the present invention has a light-mixing effect, the LED adopted for this lens may include a single-chip LED, a multi-chip LED, a COB (chip on board) module LED light source. The COB module is a device in which the chip arrays are integrated on the same printed circuit board to form a light source module. The light patches will not project the shadow of the LED's multi-chip array.

In a second aspect of the present invention, a lens for an LED street lamp for use with an LED light source having a primary lens, comprising a leas body of a secondary optical lens, the lens body having a curved outer surface, from which light is emitted, the curved outer surface having a first perimeter portion and a second perimeter portion opposite the first perimeter portion; a back surface opposite the curved outer surface, the back surface defining a recess for receiving the LED light source, the recess being closer to the first perimeter portion than to the second perimeter portion; a reflective micro-prism array formed on the back surface; the curved outer surface defining a concave surface portion at the first perimeter portion; a plurality of facets on the curved outer surface; and a mounting structure for mounting the lens body.

In another aspect of the present invention, the lens body has a longitudinal axis and a transverse axis, the lens body being shaped to provide optical characteristics to emit light from the LED light source over a wide distribution angle at a cross section along the longitudinal axis and to emit light from the LED light source over an oblique distribution angle at a cross section along the transverse axis.

In another aspect of the present invention, each of the facets on the curved outer surface of the lens body is configured to output light over a narrow angle, the facets being arranged to emit light patches that overlap light emitted from other facets to provide light mixing so that a substantially uniform color temperature light is output from the secondary lens.

In another aspect of the present invention, the curved outer surface of the lens body is shaped to emit light at an axis of refraction that is disposed at an angle relative to an optical axis of the light source of between 30 degrees and 70 degrees inclusive at a cross section of the lens body along the transverse axis.

In another aspect of the present invention, the recess includes a surface facing the LED light source that is configured to collect light rays emitted by the LED light source and refract the light rays toward the external curved surface for light distribution.

In another aspect of the present invention, the reflective micro-prism array on the back surface is configured to collect light reflected internally by the curved outer surface and to reflect the collected light toward the curved outer surface to distribution by the lens body.

In another aspect of the present invention, the mounting structure includes a plurality of retainer feet extending from the back surface of the lens body, the retainer feet being non-optical elements.

In another aspect of the present invention, the lens body is configured for use with at least one of the LED light sources selected from the group consisting of: a single chip LED light source, a multi-chip LED light source, and a chip-on-board module LED light source.

In another aspect of the present invention, the lens body is shaped to refract light from a center of the light source so that light emitted from the lens body is emitted with an axis of refraction that is disposed at an angle of between 30 degrees and 70 degrees inclusive from an optical axis of the LED light source at a cross section along the transverse axis of the lens body, the lens body being shaped to refract light from a center of the light source so that a marginal emitted light ray is disposed at an angle of −20 degrees to −45 degrees inclusive relative to the optical axis of the light source at a cross section along the transverse axis of the lens.

In another aspect of the present invention, the lens body is shaped to refract a single ray of light emitted from a center of the light source at an angle θ1 relative to the optical axis of the light source so that the ray of light is emitted from the curved outer surface at an angle of θ2 relative to the optical axis of the light source, wherein θ1 and θ2 satisfy the equation $$\theta 2 = \tan^{-1}\left\{\left(\frac{90^\circ - \theta 1}{90^\circ + \delta}\right)[\tan(\delta) - \tan(\alpha)] + \tan(\alpha)\right\},$$

wherein δ is an angle of an axis of retraction relative to the optical axis of the light source and α is an angle of a marginal light my relative to the optical axis of the light source, at a cross section along the transverse axis of the lens.

In another aspect of the present invention, the lens body is shaped to refract light from a center of the light source so that the light emitted from the lens body is distributed in an emission angle of between 120 degrees to 155 degrees inclusive at a cross section along the longitudinal axis of the lens.

In another aspect of the present invention, the lens body is shaped to refract a single ray of light emitted from a center of the light source at an angle ξ1 relative to an optical axis of the light source so that the ray of light is emitted from the curved outer surface at an angle ξ2 relative the optical axis of the light source, wherein ξ1 and ξ2 satisfy the equation $$\xi 2 = \tan^{-1}\left[\frac{\xi 1}{90^\circ} \cdot \tan(\psi)\right],$$

wherein Ψ is an angle of distribution of light from the lens body, at a cross section along the longitudinal axis of the lens.

In another aspect of the present invention, the facets include at least one of a flat plane, a concave face, and a convex face, the facets being arranged to emit light patches that overlap light emitted from other facets to provide light mixing so that a substantially uniform color temperature light is output from the secondary lens.

In another aspect of the present invention, the surface of a facet on the curved outer surface and a projection of the facet on the inner surface of the recess with reference to a center of the light source form a false lens having a divergent effect on light emitted from the facet, wherein light emitted from a center of the light source through the facet is spread by a divergent angle of approximately 3 degrees to 5 degrees inclusive, along a cross section taken along a transverse axis of the lens.

In another aspect of the present invention, the surface of a facet on the curved outer surface and a projection of the facet on the inner surface of the recess with reference to a center of the light source form a false lens having a divergent effect op light emitted from the facet, wherein light emitted from a center of the light source through the facet is spread by a divergent angle of approximately 3 degrees to 5 degrees inclusive, along a cross section taken along a longitudinal axis of the lens.

In another aspect of the present invention, the micro-prism array on the back surface of the lens body includes one of a pyramid reflector structure, a cube-corner reflector structure, and a conical reflector structure.

In a further aspect of the present invention, a method is provided for directing light from an LED light source onto a surface, including: directing light from the LED light source in an emission pattern in a primary emission direction, wherein the emission pattern is elongated in a direction transverse to a direction of emission; mixing refracted colors of light from the LED light source to provide a mixed color light emission in the primary emission direction; and redirecting light from the LED light source that is reflected from the primary emission direction so that the reflected light is returned to the primary emission direction.

In yet another aspect of the present invention, a method is provided for directing light from an LED light source onto a surface, the light source defining a parallel plane that is parallel to a light emitting surface of the LED light source, including: enclosing a light emitting portion of the LED light source with a first refracting surface of an optical body; disposing the first refracting surface at a substantially constant distance from the LED light source in a first perpendicular plane; disposing the first refracting surface at a varying distance from the LED light source in a second perpendicular plane, the first and second perpendicular planes being perpendicular to one another and perpendicular to the parallel plane of the LED light source; directing light from the LED light source into the first refracting surface of the optical body; emitting the light from the LED light source from a second refracting surface of the optical body, the emitted light defining a refracting axis offset by an angle from the first perpendicular plane, the refracting axis of the emitted light being disposed in the second perpendicular plane, the emitted light having a greatest intensity at the refracting axis; the emitting the tight including emitting the light from the LED light source in a emission pattern having a greater extent along an axis parallel to the first perpendicular plane and a lesser extent along an axis in the second perpendicular plane; mixing refracted colors of the emitted light by directing the emitted light through a plurality of facet surfaces at the second refracting surface; reflecting a portion of the light from the LED light source at the second refracting surface to generate first reflected light; and reflecting the first reflected light at a reflecting surface to provide a second reflected light, the second reflected light being directed toward the second retracting surface.

BRIEF DESCRIPTION OF THE DRAWINGS

The figures are for illustration purposes only and are not necessarily drawn to scale. The invention itself, however, may best be understood by reference to the detailed description which follows when taking in conjunction with the accompanying drawings in which.

DETAILED DESCRIPTION OF THE INVENTION

Figure 1:
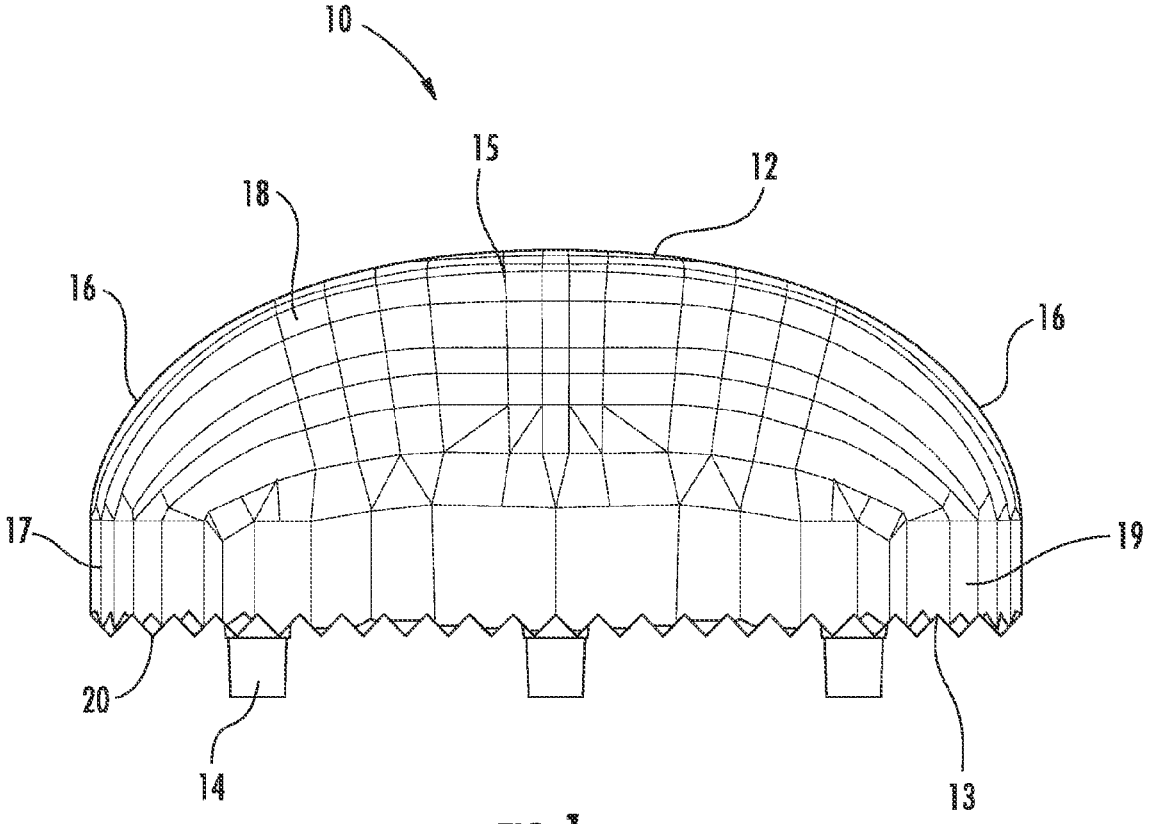
FIG. 1 is a front view of an LED street lamp lens according to the principles of the present invention.

In FIG. 1, a front view of a lens element 10 for a street lamp is shown. The lens 10 has a domed outer surface 12 that is elongated in a middle portion 15 that is shaped with a large radius curve. Ends 16 of the domed surface 12 are curved more sharply with a smaller radius curve. The domed surface 12 extends downwardly (with respect to the drawing figure) to a perimeter band 17 that extends about the outer perimeter of the lens 10. The domed surface 12 is shaped with facets or small windows 18 in a pattern over the domed surface 10. The perimeter 17 likewise has facets or small windows 19.

A back surface 13 opposite the domed surface 12 is provided with micro-prisms 20. Three legs 14 extend from the back surface 13.

Figure 2:
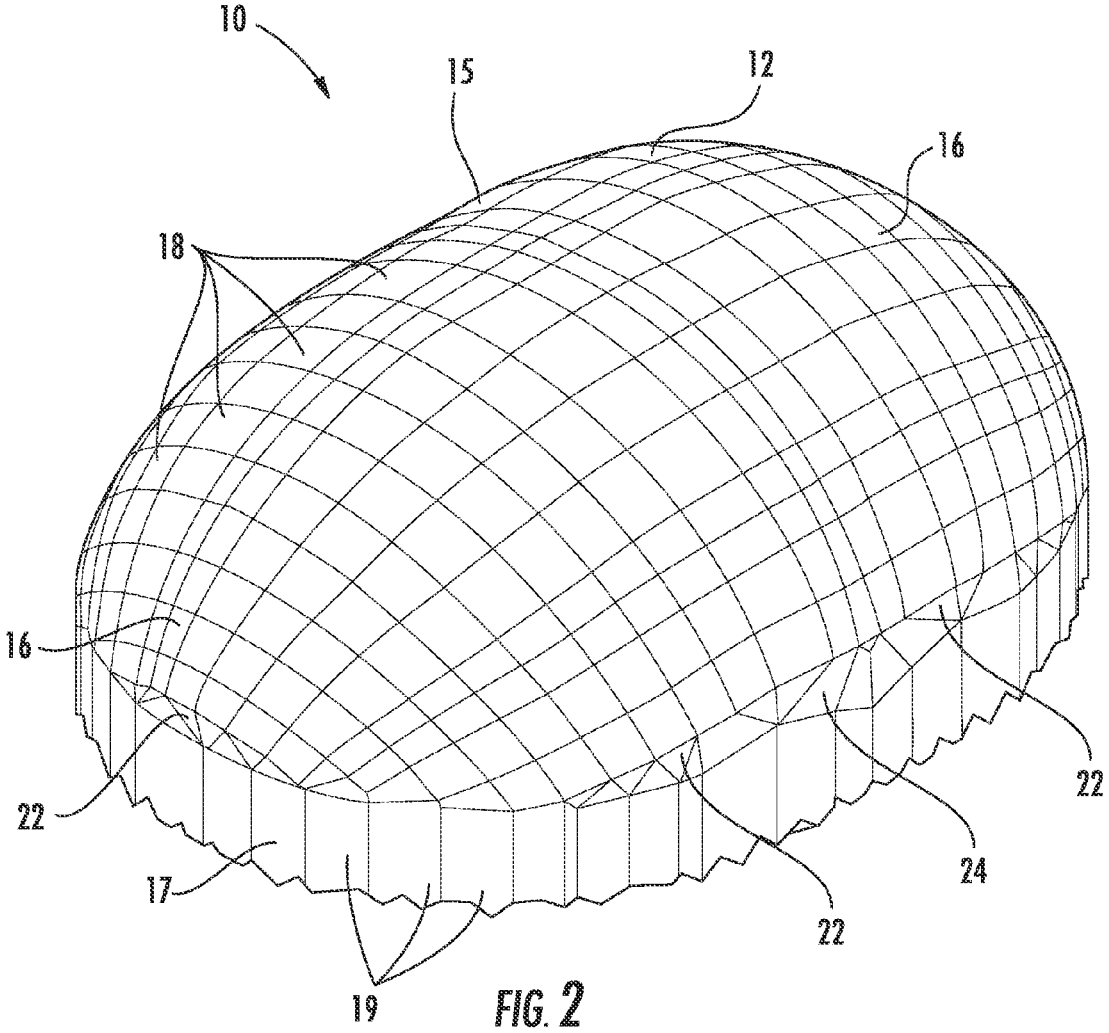
FIG. 2 is an isometric view of the street lamp lens of FIG. 1.

FIG. 2 shows the lens 10 of a generally cushion shape with an arrangement of generally rectangular facets or windows 18 on the domed outer surface 12. The perimeter band 17 includes generally rectangular shaped facets or windows 19. Triangular facets or windows 22 are arranged at the interface between the perimeter band 17 and the domed surface 12 in a transition zone. The transition zone also includes trapezoidal shaped facets or windows 24.

Figure 3:
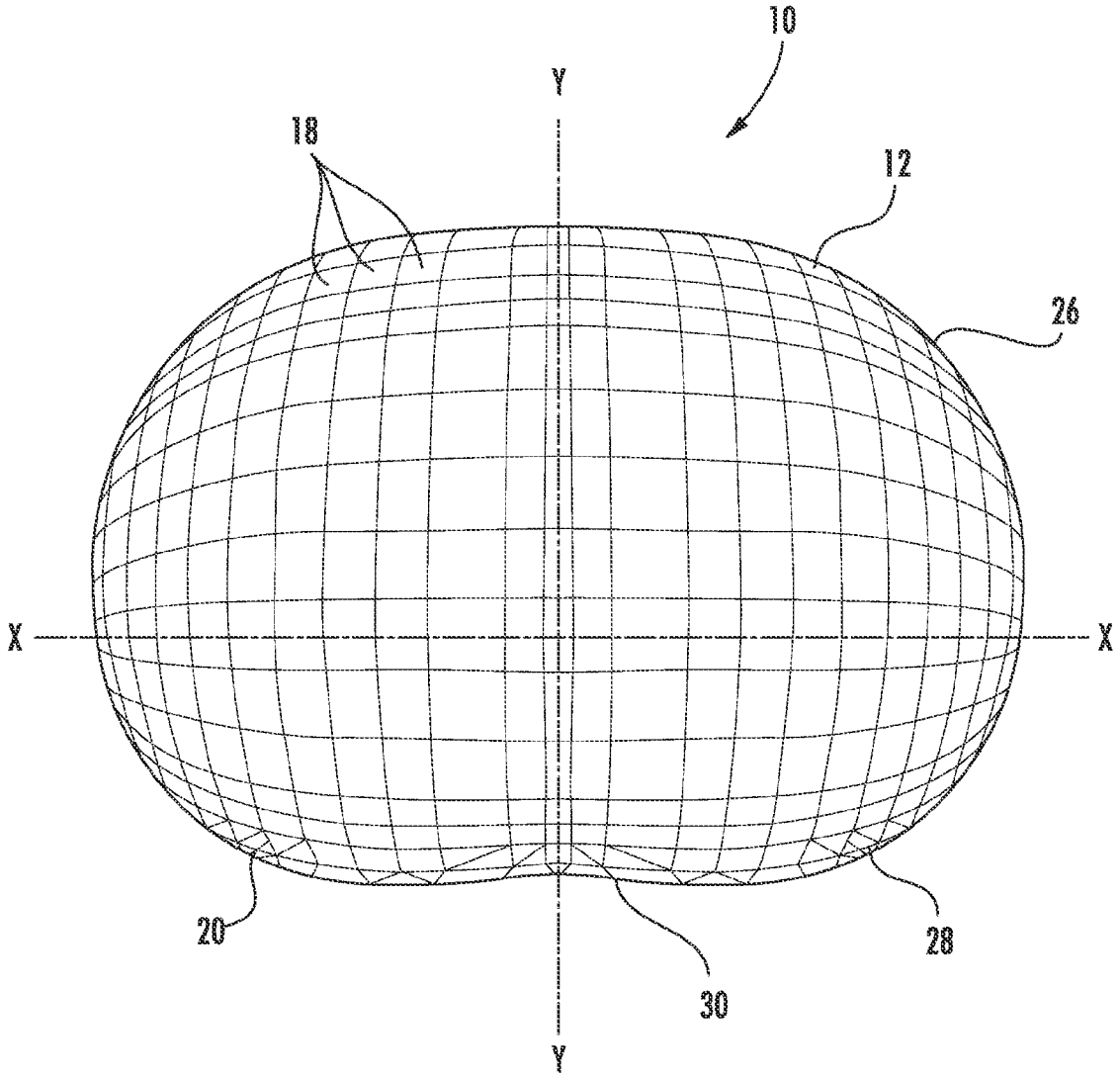
FIG. 3 is a top plan view of the street lamp lens.

With reference to FIG. 3, the lens 10 is symmetrical about a Y axis and asymmetrical about an X axis. The X axis, indicated by the line X-X, is offset from the center line of the lens 10. The X axis separates a larger portion 26 from a smaller portion 28. The perimeter of the larger portion 26 is convex in shape, whereas the perimeter of the smaller portion 28 includes end portions that are convex and a center portion 30 that is of a concave shape. In other words, the perimeter is slightly indented, or concave, at the center 30 of the smaller portion 28.

Figure 4:
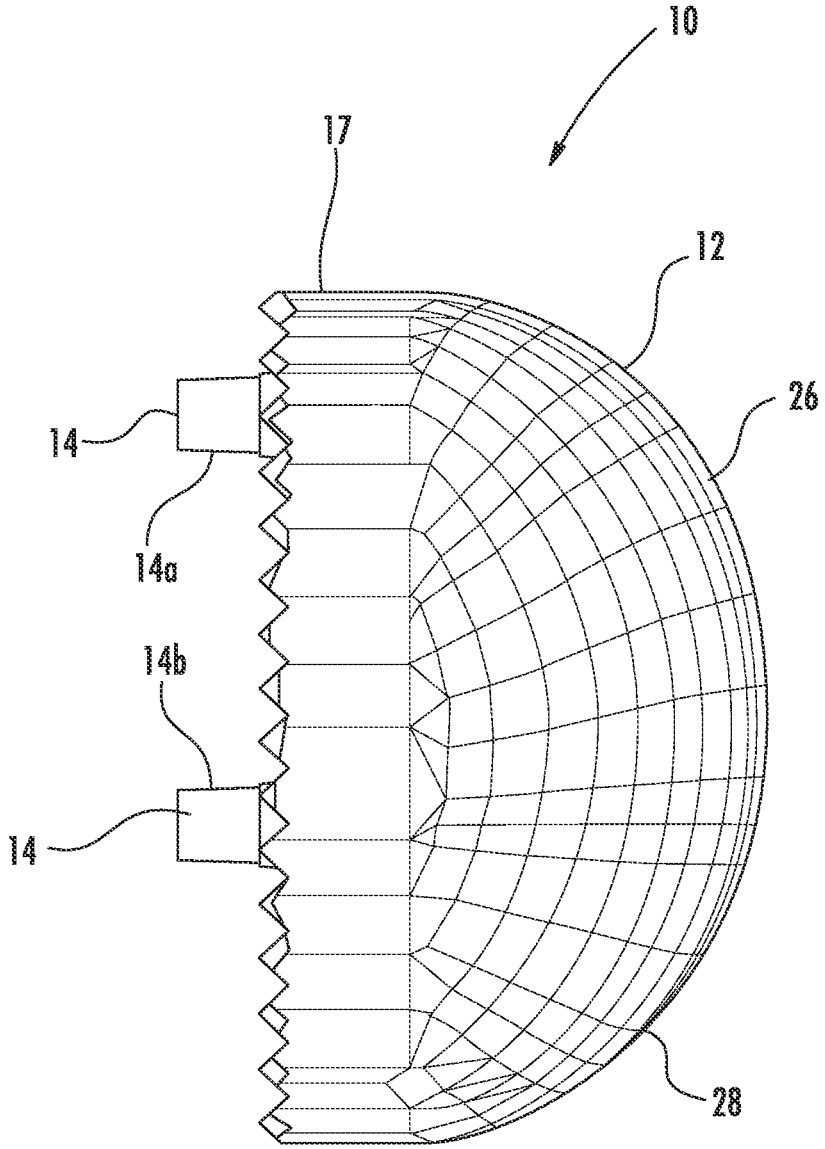
FIG. 4 is a side view of the street lamp lens.

In the end view of FIG. 4, the lens 10 has the legs 14 offset toward the larger portion 26. In particular, a leg 14*a* is disposed near the perimeter 17 of the larger portion 26. A leg 14*b* is disposed at or near the X axis of the lens 10. No leg is at the perimeter of the smaller portion 28.

Figure 5:
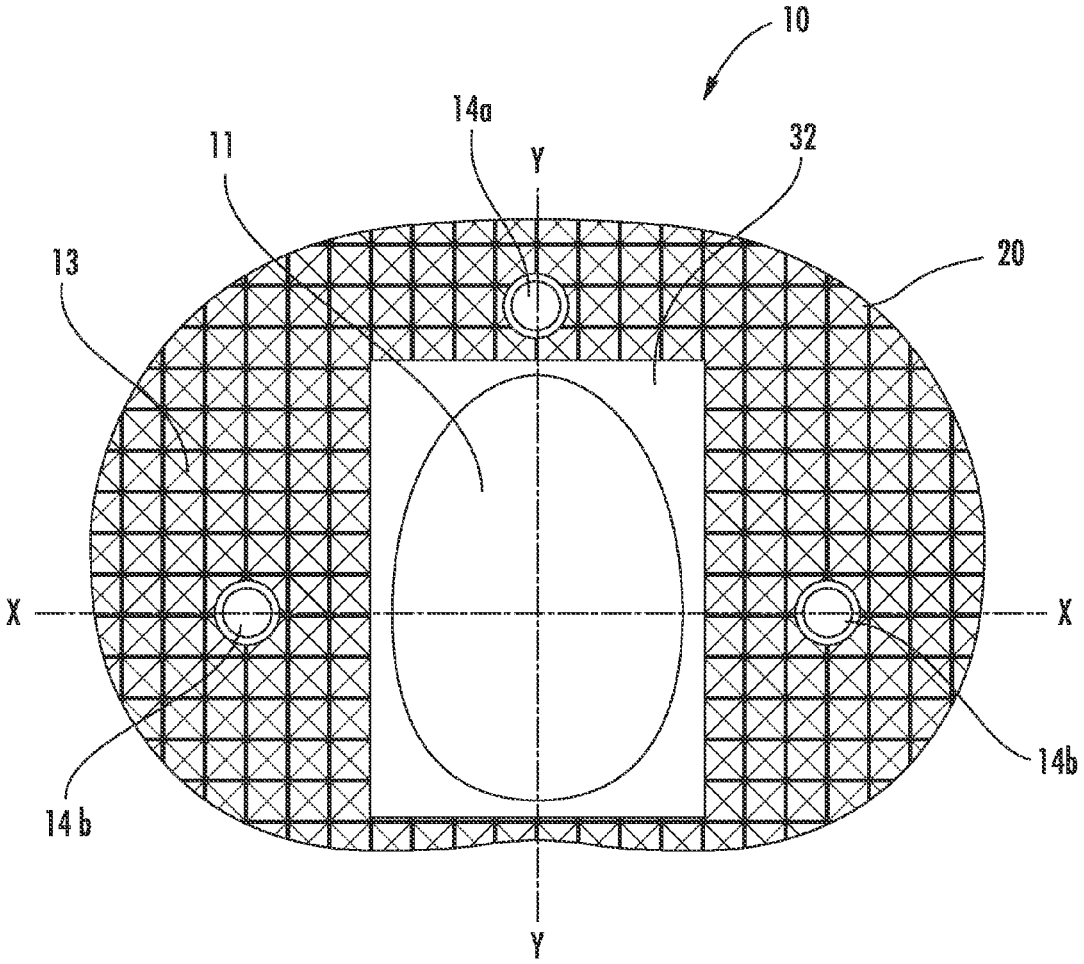
FIG. 5 is a bottom plan view of the street lamp lens.

FIG. 5 shows a view of the back surface 13. The back surface 13 is covered in the micro-prisms 20 except for a center portion 32 that includes a concave recess 11. The center portion 12 is rectangular in shape. The recess 11 is of an oval or egg shape. Three legs 14 are located in the micro-prism portion 20 and are circular in plan view. One of the legs 14*a* is disposed on the Y axis between the long axis of the recess 11 and the perimeter 17. The other two legs 14*b* are on the X axis between the recess 11 and the perimeter 17 along the short axis of the oval recess 11. The legs 14 are provided for mounting and/or retaining the lens 10 in position when the lens 10 is assembled in a street light fixture for use. The legs 14 may be of any shape required for mounting the lens.

Figure 6:
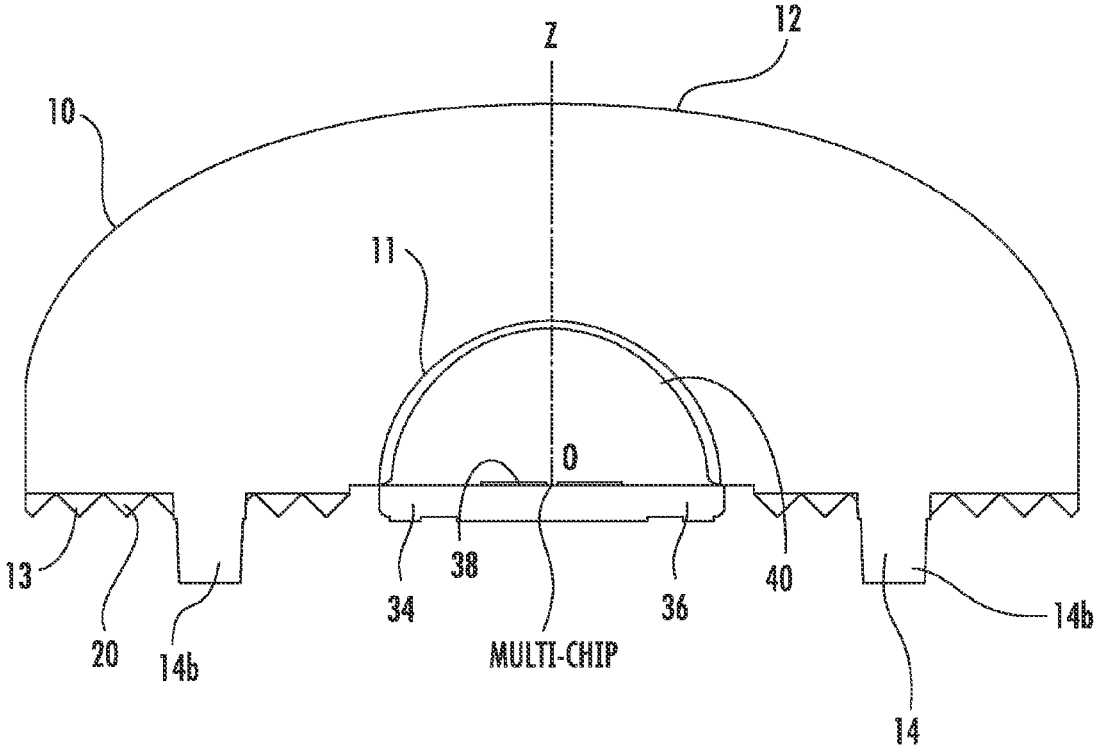
FIG. 6 is a cross-sectional view of the street lamp lens along line X-X of FIG. 3.

With reference to FIG. 6, the lens 10 is shown in cross section along the X axis. The cross sectional view extends through the legs 14*b* and through the micro-prisms 20 on the back surface 13. The micro-prisms 20 of a preferred embodiment are provided with a reflective coating, although they may be uncoated in other embodiments. The recess 11 has a generally semi-circular shape in this cross section. A multi-chip LED light source 34 is mounted at the recess 11. The light source 24 includes a base 36 on which electrical components may be mounted including one or more LED elements 38. A lens 40 is mounted on the base 36 of the light source. The lens 40 extends to adjacent the surface of the recess 11. The lens 40 on the LED light source 34 may be referred to as a primary lens and the lens 10 may be referred to as a secondary optical lens.

The LED light source used with the present lens may include single-chip LED, a multi-chip LED, or a COB (chip on board) module LED light source. Other light sources are, of course, possible. The lens 10 is structured so that the emitted light patches will not project the shadow of the LED's of a multi-chip array if a multi-chip array is used.

Figure 7:
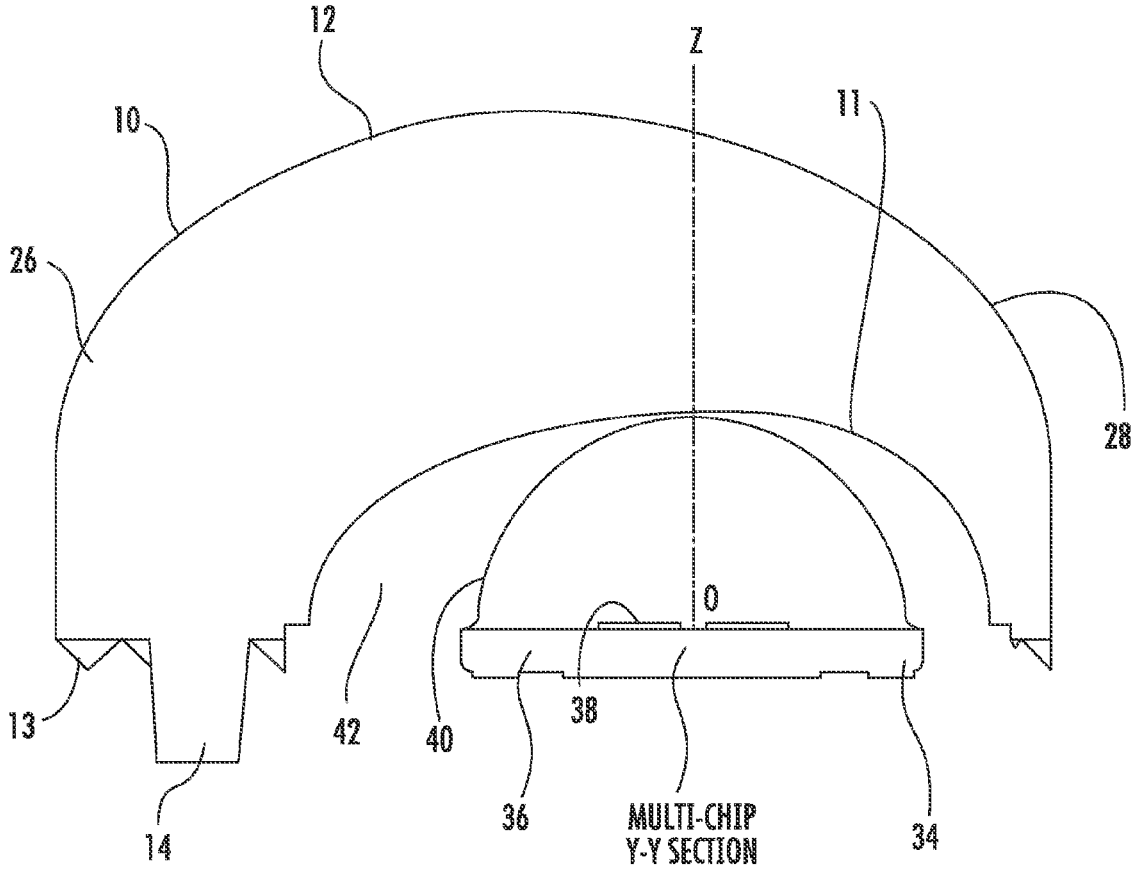
FIG. 7 is a cross-sectional view of the street lamp lens along line Y-Y of FIG. 3.

In FIG. 7, the secondary lens 10 includes the domed outer surface 12 offset relative to the X axis and offset relative to the recess 11 in this cross-sectional view taken along the Y axis. The leg 14 extends from the micro-prism formed back surface 13 to one side of the recess 11. The LED light source 34 is positioned within the recess 11 with the base 36 and primary lens 40 generally along the X axis of the secondary lens 10. The primary lens 40 is semicircular in shaped in this sectional view, but the recess 11 is elongated in the Y direction of the secondary lens 10. This results in a gap 42 between the primary lens 40 and the secondary lens 30. The gap 42 is narrowest at the peak of the primary lens and increases to either side. The gap is asymmetrical and is larger toward the larger portion 26 of the secondary lens 10 than toward the smaller portion 28. The asymmetrical shape of the secondary lens 10 results in the body of the lens 10 being thicker at the larger portion 26 and thinner at the smaller portion 28.

Figure 8:
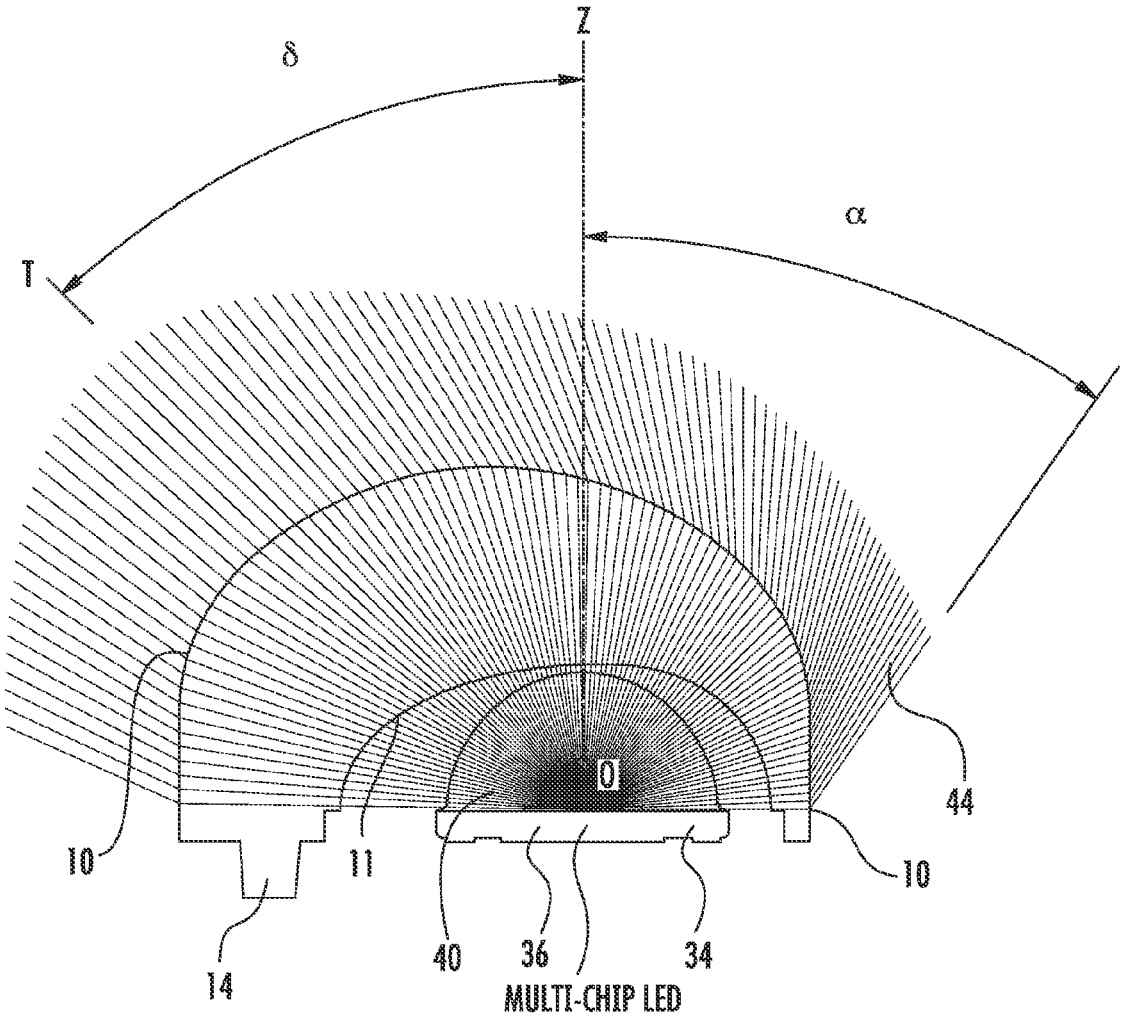
FIG. 8 is a schematic representation of light distribution from the street lamp lens.

Turning to FIG. 8, a light distribution pattern 44 is shown in a cross section along the Y-Y axis. The light source 34 includes multiple LED light sources that project light from the base 36 through the primary lens 40. The primary lens 40 may be hemispherical or parabolic or other shape. In one example, the primary lens is rotationally symmetrical. Light, indicated by radial lines extending from the light source 34, is distributed over a wide angle of approximately 180 degrees by the primary lens 40, although it is likely that them is a predominance of light emitted at the optical axis of the light source due the nature of LEDs.

Light leaving the light source 34 encounters the inner surface of the recess 11 and enters the secondary lens 10. A combination of refraction and the shaping of the secondary lens 10 results in the light emitted from the secondary lens having an asymmetrical distribution. In particular, the emitted light is directed along a primary direction T that is at an angle δ from a perpendicular direction Z from the base 36 at O. The refracting angles of light beams emitted by the lens 10 bend toward the primary direction T, so that the primary direction may be referred to as the axis of refraction. Stated another way, the axis of refraction is at an angle δ to the perpendicular Z of the light source. The light is emitted at the smaller portion of the lens 10, which is nearer the light source 34 as a result of the asymmetric structure of the lens 10, is at a maximum refraction angle α.

The principles of light distribution along the Y-Y section on the base face of the curved outer surface 12 of the secondary optical lens involved are as follows. The light ray emitted from point O at the center of the light-emitting face of the multi-chip LED light source 34 is retracted by the concave incident face of the recess 11 onto the base face of curved surface 12. The base face of the curved outer surface 12 distributes the incident light ray in an oblique manner and the axis of the emergent light ray is OT, i.e. all emergent light beams exit along the OT axis after light distribution. The angle between the refracting axis OT of the lens 10 and the optical axis OZ of the light source that passes point O at the center of the LED light-emitting face and perpendicular to the chip light-emitting face is δ; δ is between 30 degrees and 70 degrees; here δ is preferably selected as 45 degrees. For the marginal light ray emitted from point Q at the center of the chip light-emitting face and crossing the rightmost side of the base face of curved surface 12, the angle between the emergent marginal light ray and the optical axis OZ is α; where α is between −20 degrees and −45 degrees, and here α is preferably selected as −35 degrees. Here it is assumed that the angle is positive when the light ray is to the left of optical axis OZ, and negative when it is to the right of OZ.

Figure 9:
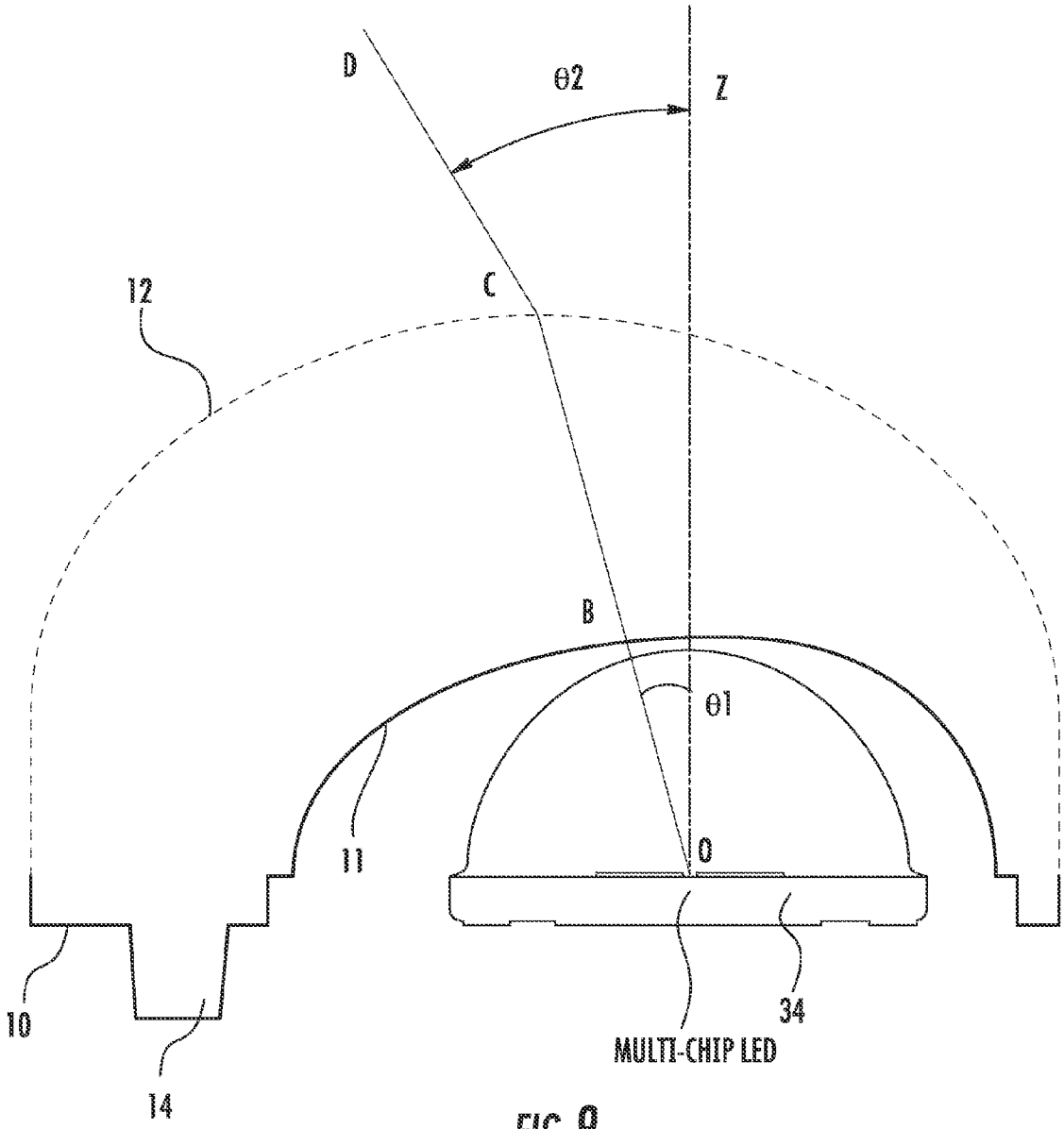
FIG. 9 is a schematic diagram of a single ray of light emitted by the street lamp lens.

In FIG. 9 a single light ray is emitted from the secondary lens 10. The single light ray explains the distribution of light along the Y axis of the lens 10. For the secondary optical lens 10 according to a preferred embodiment, a light ray is distributed by the base face of the curved outer surface 12 along the Y-Y section. A light ray OB emitted from point O at the center of the light-emitting face of the multi-chip LED light source 34 is refracted by the concave incident face of the recess 11 onto point C on the base face of curved surface 12, and outputted as light ray CD after light distribution. Assuming that the angle between light ray OS and optical axis OZ of the light source is θ1 and the angle between the emergent light ray CD and the optical axis OZ is θ2, both θ2 and θ1 shall satisfy the following light distribution conditions:

$$\theta 2 = \tan^{-1}\left\{\left(\frac{90^\circ - \theta 1}{90^\circ + \delta}\right)[\tan(\delta) - \tan(\alpha)] + \tan(\alpha)\right\} \quad \text{Equation (1)}$$

The coordinates (X, Y) of each point on the contour line along the Y-Y section of the base face of curved surface 12 can be calculated using iteration in the numerical calculation method of the curve according to the light distribution conditions of emergent and incident light rays as specified in Equation (1). Thus the shape of the section's contour line can be determined.

Figure 10:
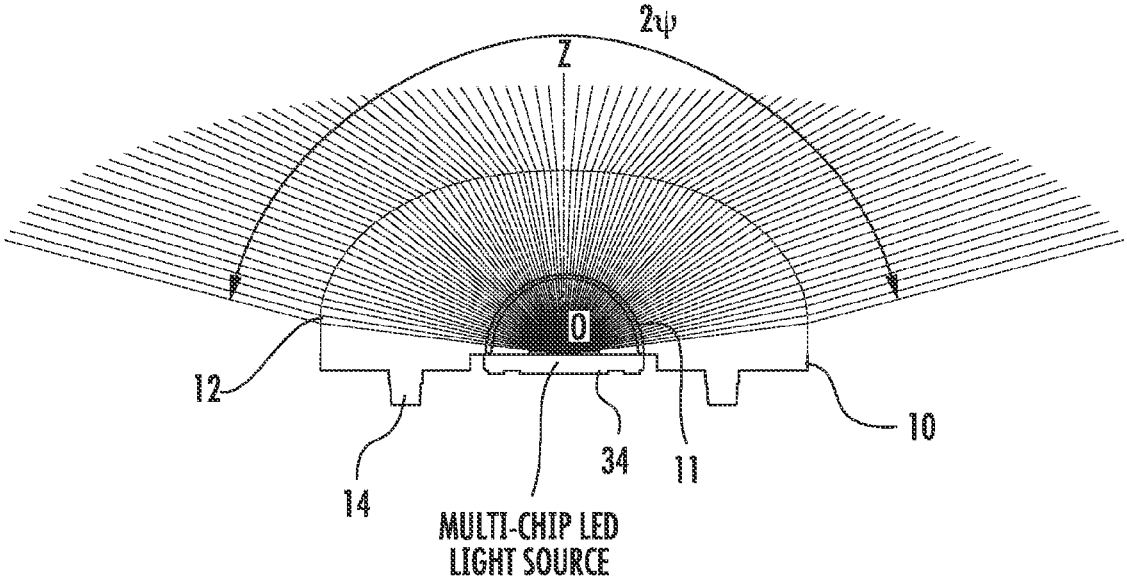
FIG. 10 is schematic diagram of light distribution along an X axis of the street lamp lens.

In FIG. 10, the light distribution along the X-X section of the secondary optical lens 10 provides a different distribution pattern than that along the Y-Y axis. The principles of light distribution along the X-X section on the base face of the curved outer surface 12 provide a wide, symmetrical distribution. The light rays emitted from point O at the center of the light-emitting face of the multi-chip LED light source 34 are refracted by the concave incident face of the recess 11 onto the base face of the curved outer surface 12. The base face of the curved outer surface 12 distributes the incident light rays in a wide-angle spectrum. The angle of emergent light rays has a full width 2Ψ; 2Ψ is between 120 degrees and 155 degrees, and here 2Ψ is preferably selected as 150 degrees.

Figure 11:
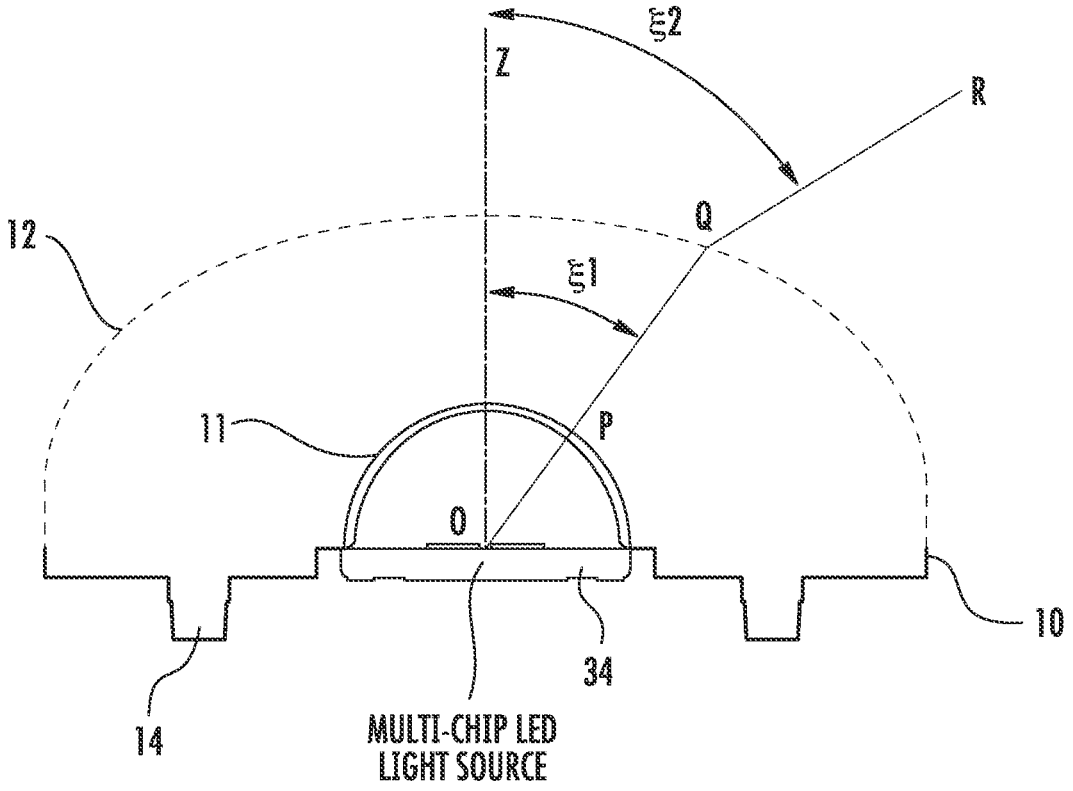
FIG. 11 is a schematic diagram of a single ray of light emitted from the street lamp lens along an X axis.

In FIG. 11 a single light ray along the X-X section of the lens 10 is transmitted from the curved outer surface 12 of the secondary optical lens. The distribution of light along the X-X section is explained with reference to the single light ray. A light ray OP emitted from point O at the center of the light-emitting face of the multi-chip LED light source 34 is refracted by the concave incident face of the recess 11 onto point Q on the base face of curved outer surface 12 and outputted as a light ray QR after light distribution. Assuming that the angle between light ray OP and optical axis OZ of the light source is ξ1 and the angle between the emergent light ray QR and the optical axis OZ is ξ2, both ξ2 and ξ1 shall satisfy the following light distribution conditions:

$$\xi 2 = \tan^{-1}\left[\frac{\xi 1}{90^\circ} \cdot \tan(\psi)\right] \quad \text{Equation (2)}$$

The coordinates (X, Y) of each point on the contour line along the X-X section of the base face of curved surface 12 can be calculated using iteration in the numerical calculation method of the curve according to the light-distribution conditions of emergent and incident light rays as specified in Equation (2). Thus the shape of the section's contour line can be determined.

The contour lines of the base face of curved surface 12 on the X-X and Y-Y sections calculated according to Equations (1) and (2) above are further scanned via 3-D modeling software in order to establish a 3-D solid model of the lens.

The curved outer surface 12 is assumed to be a smooth curved surface in the 3-D solid lens model that is constructed according to the light distribution Equations (1) and (2). This will result in the projected light patches having color differences, i.e. bluish in the middle and yellowish at the edges, due to differences in refraction of the different colors of light by the lens. In the preferred embodiment, light-mixing facets or windows are provided on the curved outer surface 12. A so-called light-mixing facet or window may take the form of a small planar face, a small convex face or a small concave face. The facet or window generates a dispersed light beam with a very small dispersion angle. The dispersed light beams generated by each small facet overlap to create a light-mixing effect. The overlapped light patches have relatively uniform color temperature. Small planar facets are preferably selected for light-mixing according to one embodiment.

Figure 12:
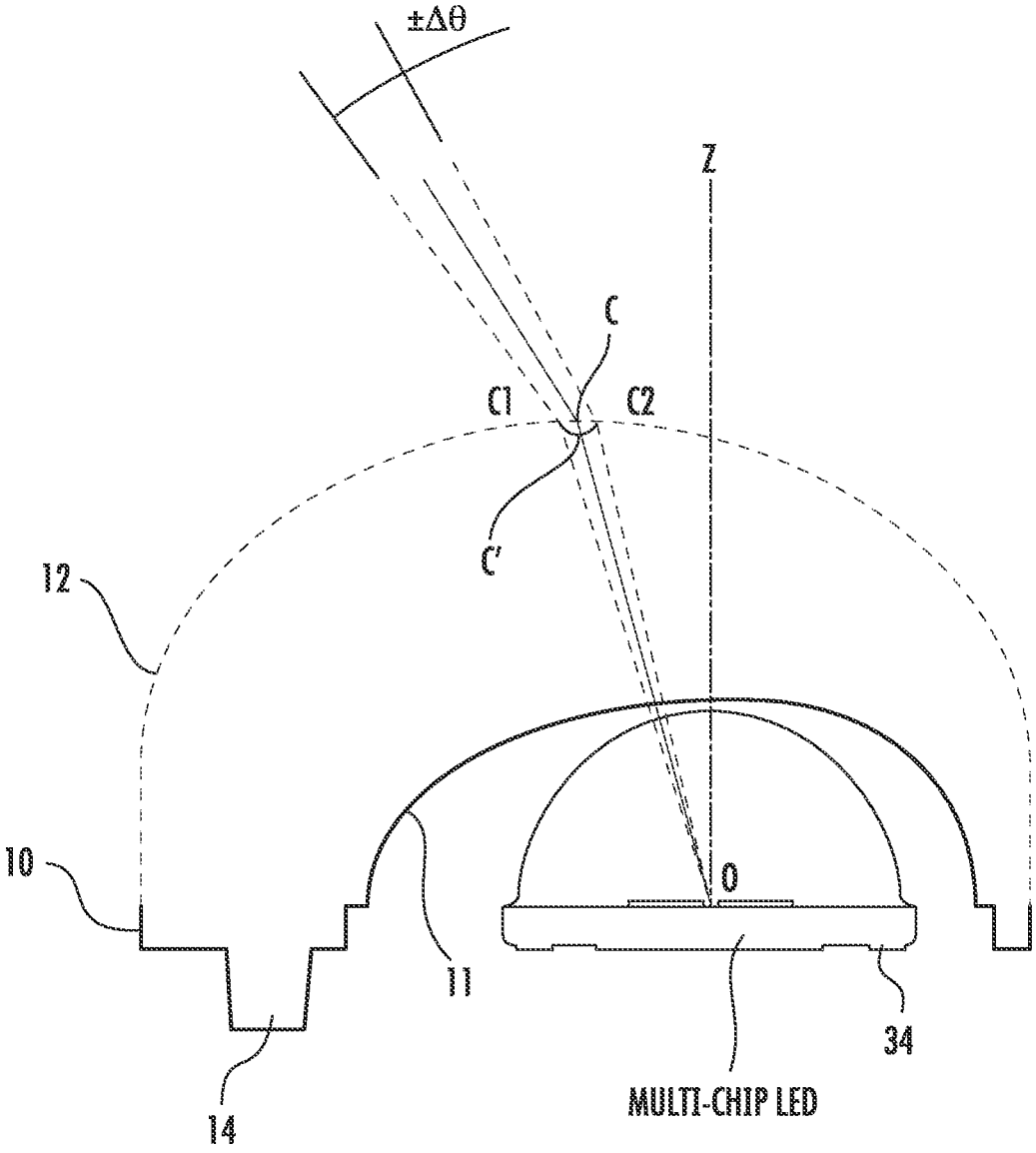
FIG. 12 is a schematic diagram of adjacent rays of light being emitted from the street lamp lens along the Y axis.

Referring to FIG. 12, a single facet or window C is show on the curved outer surface 12 of the secondary optical lens 10 in a schematic diagram along the Y-Y section showing light-mixing. The light-mixing in this example of a single facet occurs for facets over the entire outer surface 12 of the secondary optical lens 10. Assuming that the light incident on the small facet on the curved surface defines an included angle established by lines C1-C'-C2 on the outer surface 12. The camber line or bisector line has a radius of curvature of R'. The projection of the facet surface on the surface of the recess is established by lines C1-C-C2, which has a local radius of curvature of R. The projection of the facet on the outer surface as defined by lines C1-C'-C2 and on the inner surface of the recess as defined by lines C1-C-C2 will form a miniature false lens. The light rays emitted from the point O at the center of the LED light-emitting face will generate an angle of divergence at a size of $\pm\Delta\theta$ here after passing this false lens. The angle of divergence $\pm\Delta\theta$ equals the numerical aperture angle of the false lens formed, and is related to the facet's radius of curvature R' and the local radius of curvature R of the base face, or inner surface of the recess, of curved surface 12 at this point. For facet dispersion angle $\Delta\theta$, a range of approximately 3 degrees to approximately 5 degrees is preferably selected. The dispersion caused by the facets cause the light output by the facets to overlap and thereby provide color mixing of the light from nearby facets.

Figure 13:
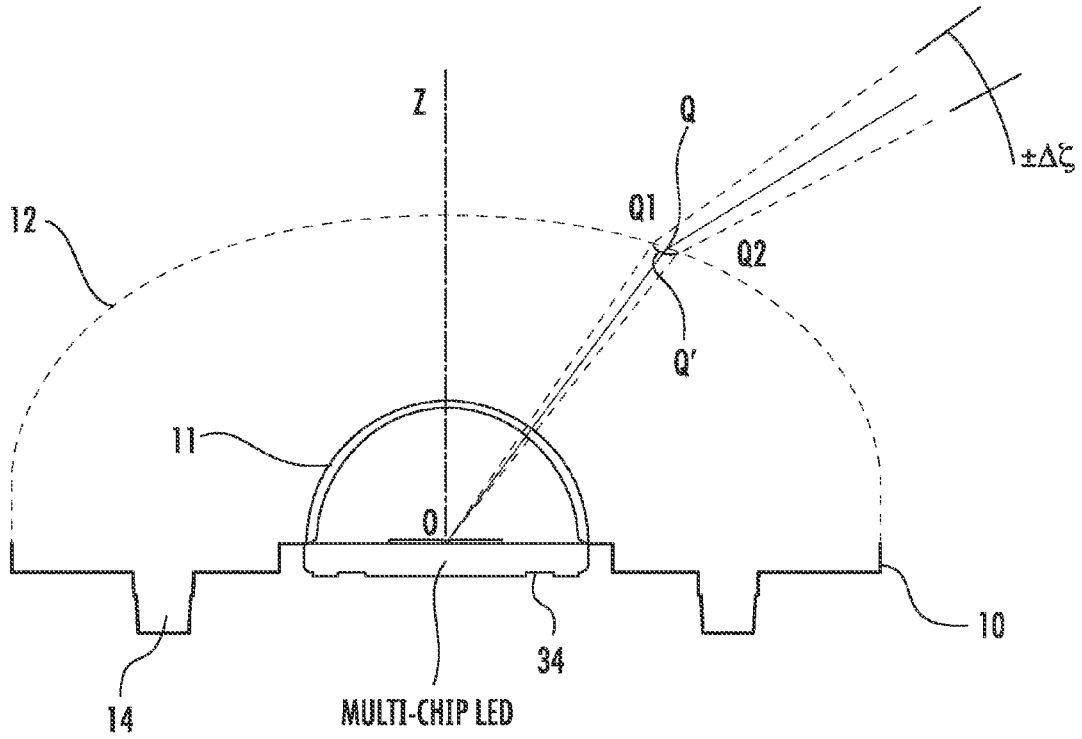
FIG. 13 is a schematic diagram of adjacent rays of light being emitted from the street lamp lens along the X axis.

With reference to FIG. 13, light-mixing dispersion by a single facet on curved outer surface 12 is shown along the X-X section. The schematic diagram of light-mixing of a single facet may be translated to multiple facets on the curved outer surface 12 of the secondary optical lens 10. Assuming that the angle of the incident light on the section of the small facet on curved surface 12 is defined by the included angle of the lines Q1-Q'-Q2; that the camber lines line has a radius of curvature of R'; and that projected incident light is defined by the angle of lines Q1-Q-Q2 on the base face or surface of the recess, and that this inner surface has a local radius of curvature of R, the surfaces defined by the lines Q1-Q'-Q2 and Q1-Q-Q2 will form a miniature false lens. The light rays emitted from point O at the center of the LED light-emitting face will generate an angle of divergence at a size of $\pm\Delta\xi$ here after passing this false lens. The angle of divergence $\pm\Delta\xi$ equals the numerical aperture angle of the false lens formed, and is related to the facet's radius of curvature R' and the local radius of curvature R of the base face of curved surface 12 at this point. For $\Delta\xi$, a range of approximately 3 degrees to approximately 5 degrees is preferably selected.

The diffused light beams generated by numerous facets on the curved surface 12 of the lens are overlapped and mixed to form light patches of uniform color temperature on the road surface, hence essentially eliminating the color temperature differences between the middle and the edges of the light patches.

Figure 14:
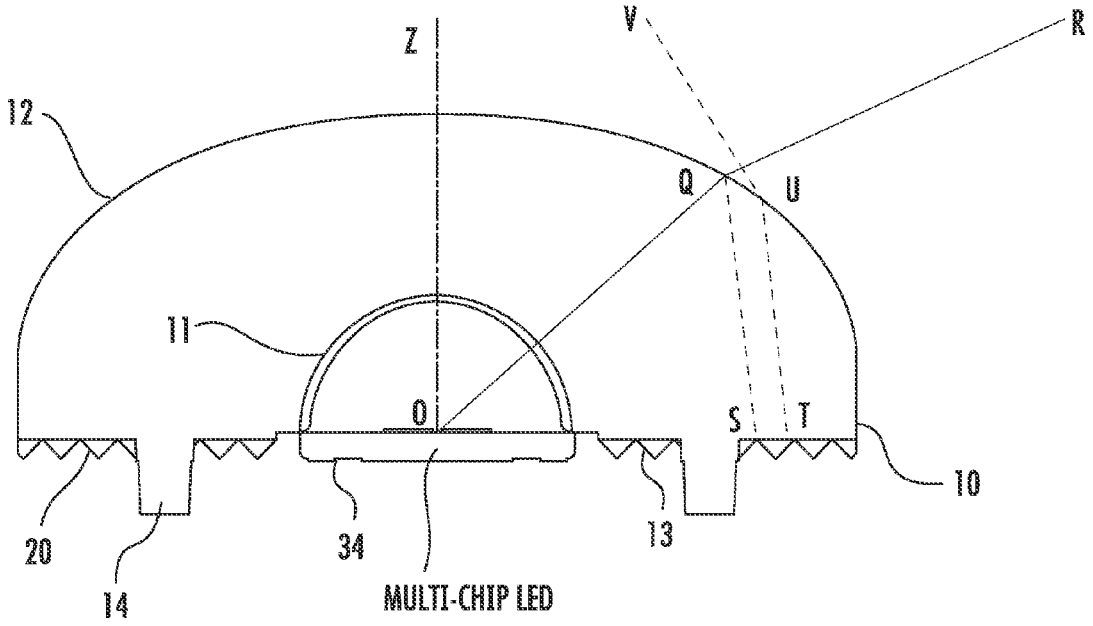
FIG. 14 is a schematic diagram of a single ray of light being emitted from the street lamp lens that includes a micro-prism back plane.

So far, the discussion of light dispersion and overcoming diffraction effects has focused on the outer surface 12. The back surface 13 was assumed to be smooth and have no impact on the emitted light. In FIG. 14 micro-prisms are provided on the back surface 13 to provide stray light collection by the micro-prisms 20 formed in the back of the secondary optical lens 10.

When the curved outer surface 12 of the secondary optical lens 10 distributes the incident light rays on the X-X section, the emergent light beams have a very large angle. Therefore, the Fresnel reflection loss will be very high at the lens medium/air interface. Such Fresnel reflection loss will be reflected by the air interface onto the back 13 of the lens 10 in the form of stray light, as shown by the dotted line QS in FIG. 14. If the back 13 of the lens is not treated in any way, this portion of light energy cannot be used and will be lost. In consideration thereof, a micro-prism array 20 with reflective effects is provided at the back of the lens according to one embodiment. The micro-prism array 20 may be formed of elements having a pyramid-shaped, a corner cube shaped or a conical shaped structure; a pyramid structure is preferably selected for the micro-prism elements here. The pyramid reflector structure can realize two total reflections of the stray light QS, re-collect it and cast it towards the front of the lens (as dotted line TU of FIG. 14 shows). Therefore, the outputted light can be directed onto a road surface (the output light ray UV shown in FIG. 9), hence maximizing the output efficiency of the lens.

Figure 15:
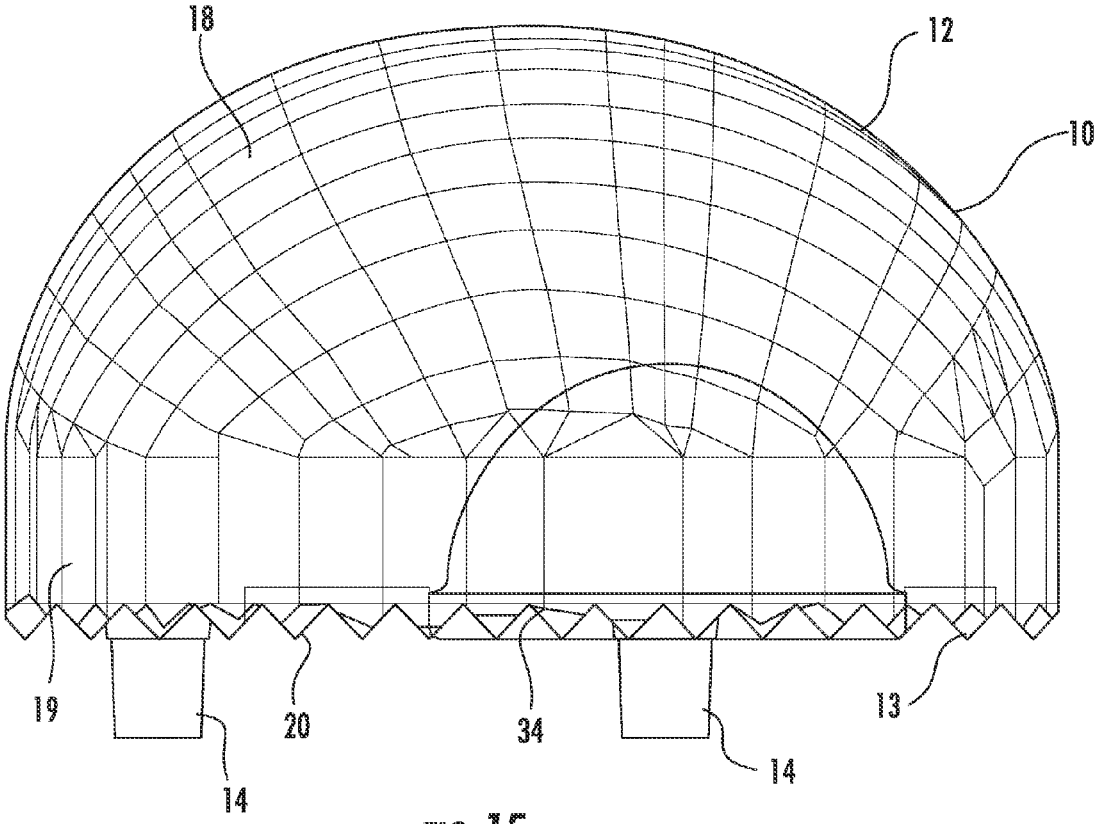
FIG. 15 is a side view of a 3D model of the street lamp lens.

FIG. 15 is a 3-D model of the secondary optical lens 10 showing the relative positions of the elements. The light source 34 is located off-center of the lens 10. The faceted outer surface 12 provides either planar, convex or concave surface portions or windows for distributing the emitted light without separation of colors due to refraction. The lower surface of the light source 34 is even with the peaks of the micro-prism array 20 of the back surface 13 in this embodiment.

Figure 16:
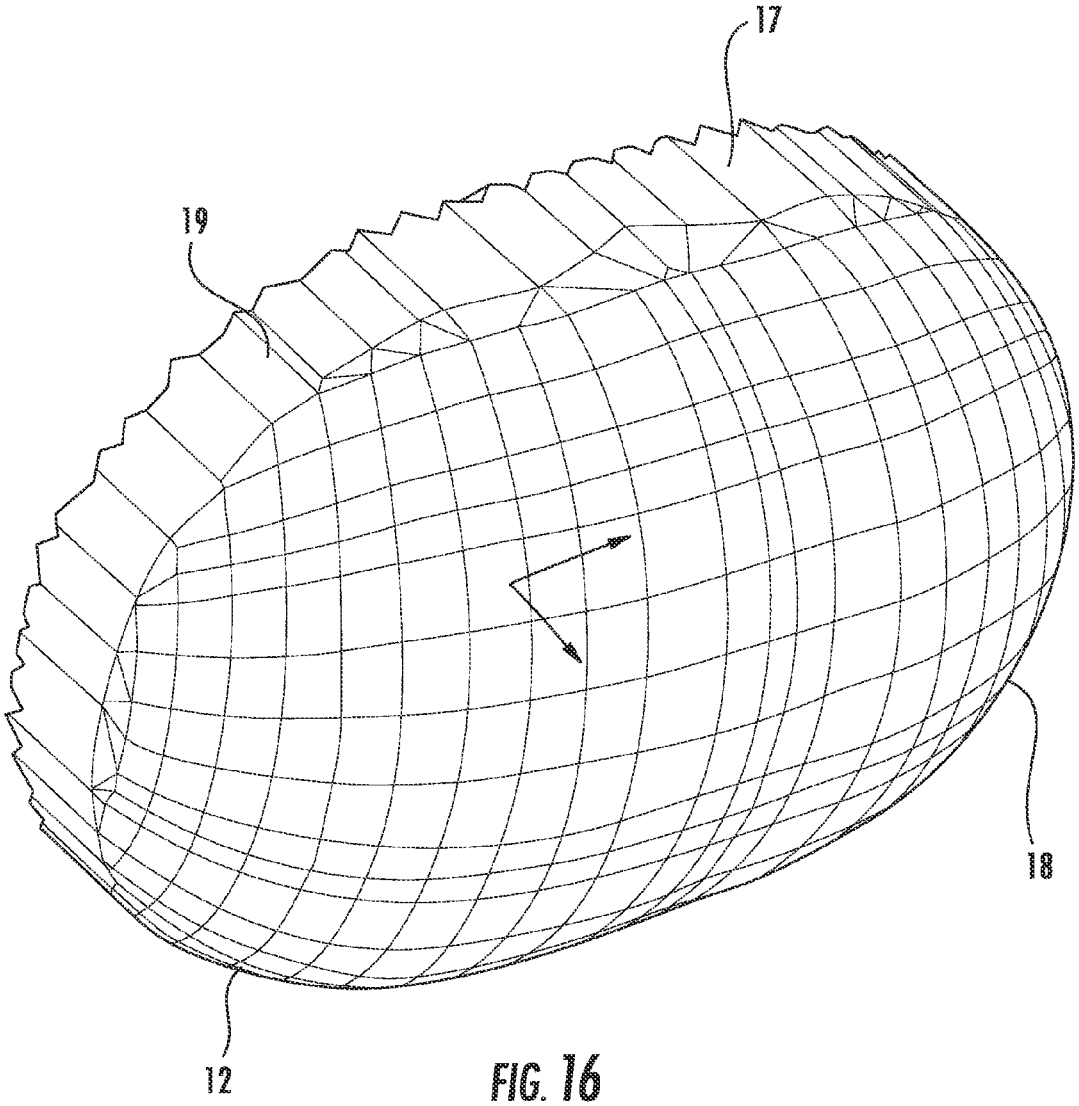
FIG. 16 is a front perspective view of the 3D model of the street lamp lens.
Figure 17:
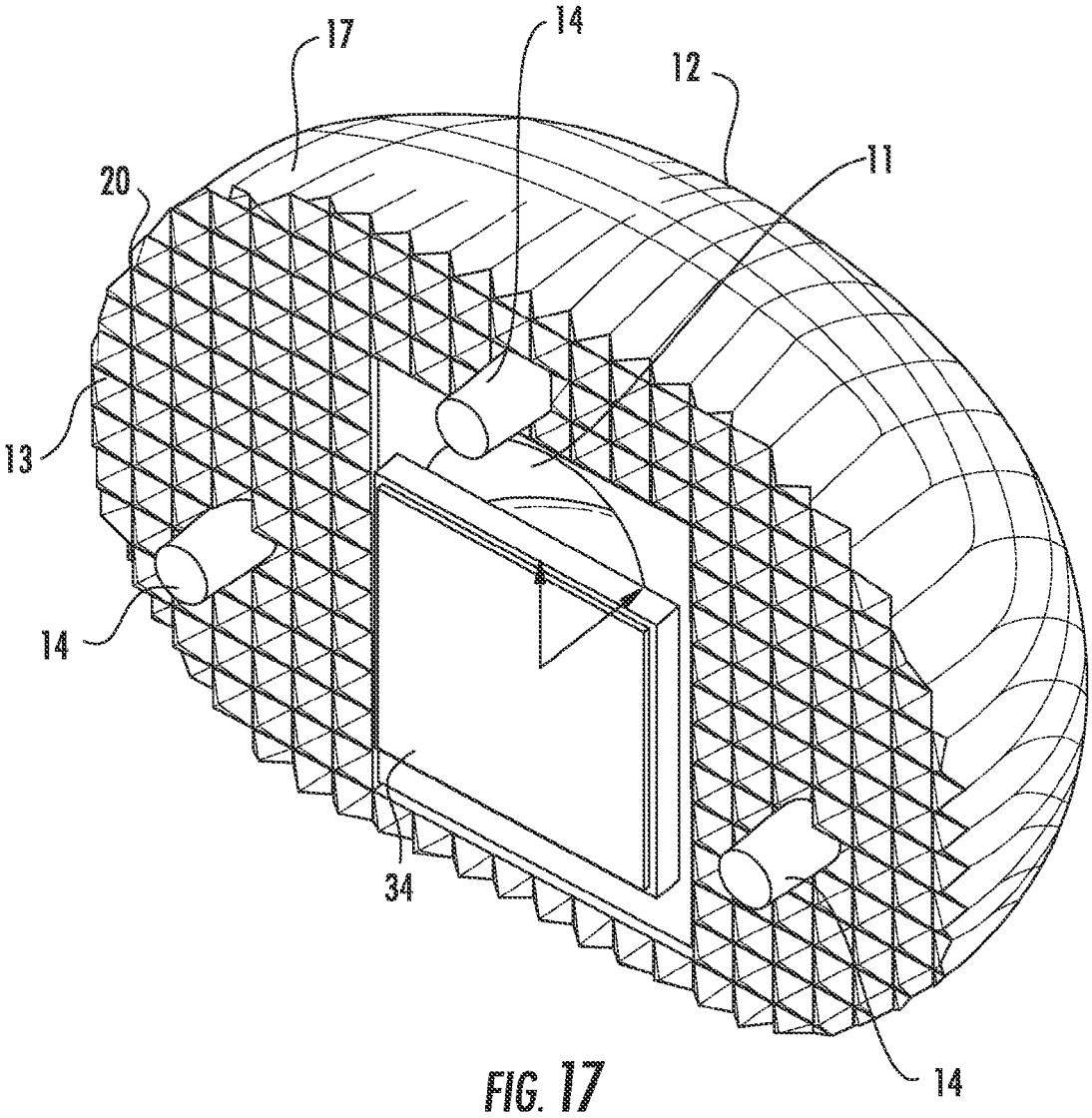
FIG. 17 is a back perspective view of the 3D model of the street lamp lens.

FIG. 16 shows the outer surface 12 including the facets or windows 18 on the domed surface 12 and the facets 19 on the perimeter 17. FIG. 17 shows the back surface 13 with the micro-prism array 20 and the recess 11 into which the light source 34 is mounted.

Figure 18:
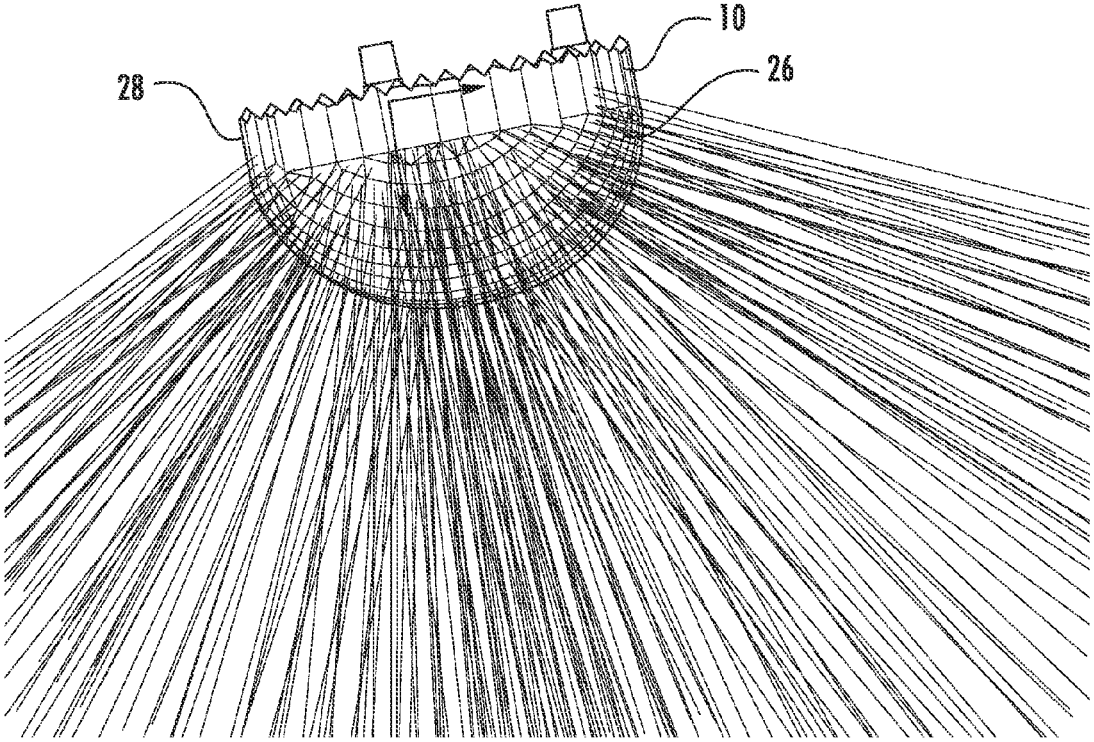
FIG. 18 is a ray tracing diagram front an end view of the street lamp lens.
Figure 19:
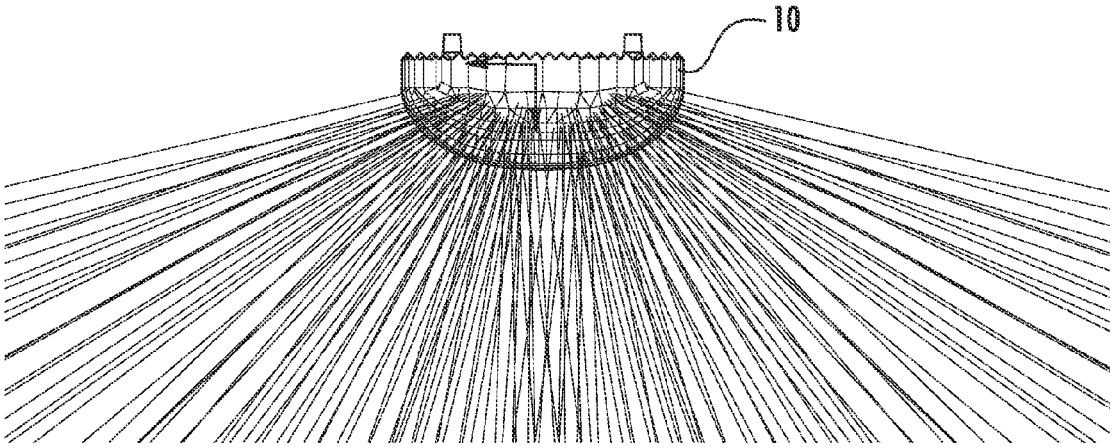
FIG. 19 is a ray tracing diagram from a side view of the street lamp lens.

Turning to FIGS. 18 and 19, in one example, an LED light source 34 in the form of an American CREE MKR four-chip LED with a luminous flux of 800 lumens was mounted in a street lamp lens 10 according to an embodiment of the present invention. An observation screen was placed 10 meters before the lens. The tracing of the light rays emitted from the faceted lens 10 is shown in the transverse and longitudinal directions in FIGS. 18 and 19, respectively. In the transverse view of FIG. 18, the light rays are asymmetrical with a concentration of light toward the larger portion of the lens 10. The light rays are distributed evenly in the longitudinal view of FIG. 19.

Figure 20:
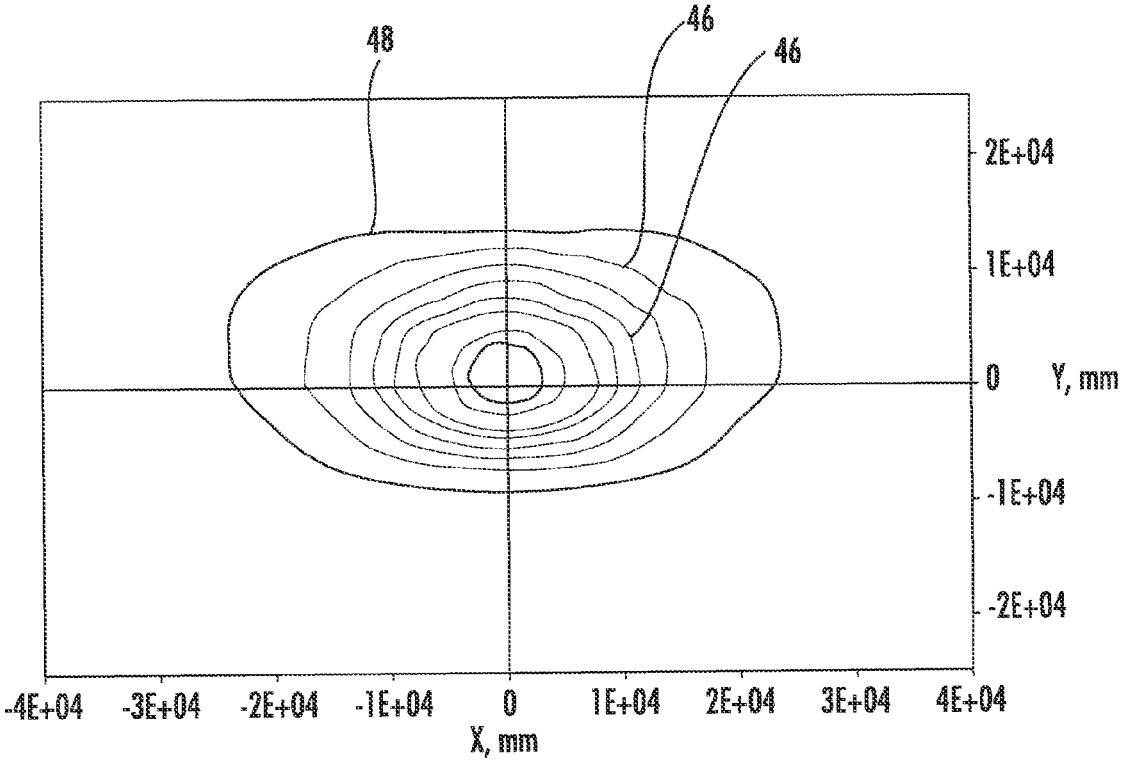
FIG. 20 is a graph of contour lines of light output from the street lamp lens.
Figure 21:
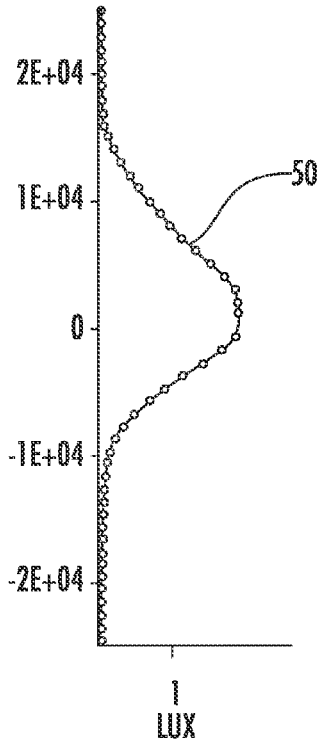
FIG. 21 is a side view of the contour lines of light output along the Y axis of FIG. 20.
Figure 22:
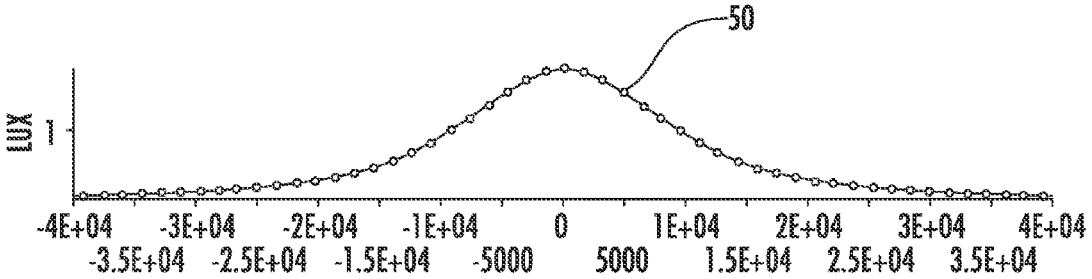
FIG. 22 is a side view of the contour lines of light output along the X axis of FIG. 20.

FIG. 20 shows the contour lines 46 of illumination intensity on an observation screen located 10 meters in front of the lens 10. It can be seen that the resulting light patch 48 is distributed in an elongated oval shape. When mounted above a road surface in a street light fixture with the long axis of the elongated oval parallel to the road direction, the light patch 48 is over 35 meters in length along the road direction, and about 18 meters wide perpendicular to the road direction. Light intensity values 50 for the contour lines of FIG. 20 are plotted in FIGS. 21 and 22.

Figure 23:
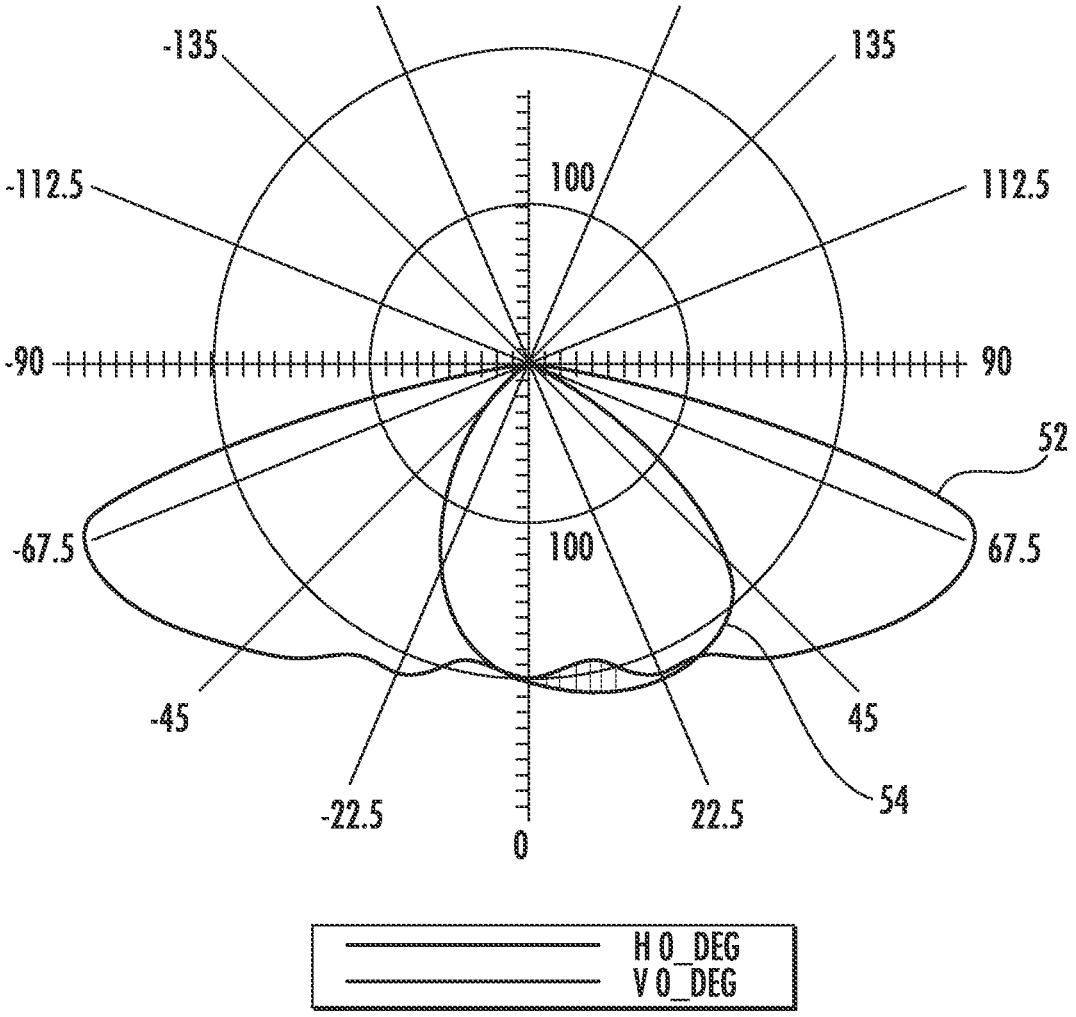
FIG. 23 is a graph of light distribution emitted by the street tamp lens.

FIG. 23 is a graph of the far-field angle distribution of the light intensity of the lens, i.e. the curve of light distribution. In the H direction, the curve 52 of light distribution takes the shape of a wide-angle bat wing, with the light beam angle having a full width of about 150 degrees. In the V direction, however, the curve 54 of light distribution is off-axis, with the light beam angle having a foil width of about 80 degrees.

A simulation was run of the LED street lamp lenses mounted along a roadway. For the simulation, an input the IES file of the lens plus CREE MKR light source into the road illumination effect software. The simulation assumes that the road is 12 meters wide and has 3 lanes; the road is a Class R3 road with a maintenance factor of 0.8 and is made of asphalt; the lamp head is at a height of 10 meters, the lamp post has an outreach of 1 meter over the road surface and the cantilever is 1.5 meters long; the lamp post interval is 35 meters; and the lighting fixture has a luminous flux of 14,900 lumens (140 watts). Then all uniformity parameters of its illumination and brightness (luminance) satisfy all necessary design standards of road lighting, as FIG. 14 and FIG. 15 show.

The simulation results are as follows:

| | | | | | |
|---|---|---|---|---|---|
| Maintenance factor: 0.80 | | | Scale: 1:294 | | |
| Grid: 12 × 9 points | | | | | |
| Appurtenant street environment factors: Road 1. | | | | | |
| Asphalt: R3, q0: 0.070 | | | | | |
| Selected illumination class: ME4b | | | (All luminosity requirements have been satisfied.) | | |
| | Average brightness [cd/m$^2$] | U0 | UI | TI [%] | Surrounding illumination factors |
| Calculated actual value: | 0.91 | 0.43 | 0.85 | 11 | 0.51 |
| Value set as per class: | ≥0.75 | ≥0.40 | ≥0.50 | ≤15 | ≥0.50 |
| Satisfied/unsatisfied: | ✓ | ✓ | ✓ | ✓ | ✓ |

| Appurtenant observer (3 quantities): No. | Observer | Position [m] | Average brightness [cd/m$^2$] | [cd/m$^2$] | U0 | UI | TI [%] |
|---|---|---|---|---|---|---|---|
| 1 | Observer 1 | (−60.000, 2.000, 1.500) | | 0.91 | 0.44 | 0.88 | 11 |
| 2 | Observer 2 | (−60.000, 6.000, 1.500) | | 0.98 | 0.43 | 0.85 | 10 |
| 3 | Observer 3 | (−60.000, 10.000, 1.500) | | 1.04 | 0.43 | 0.92 | 7 |

Figure 24:
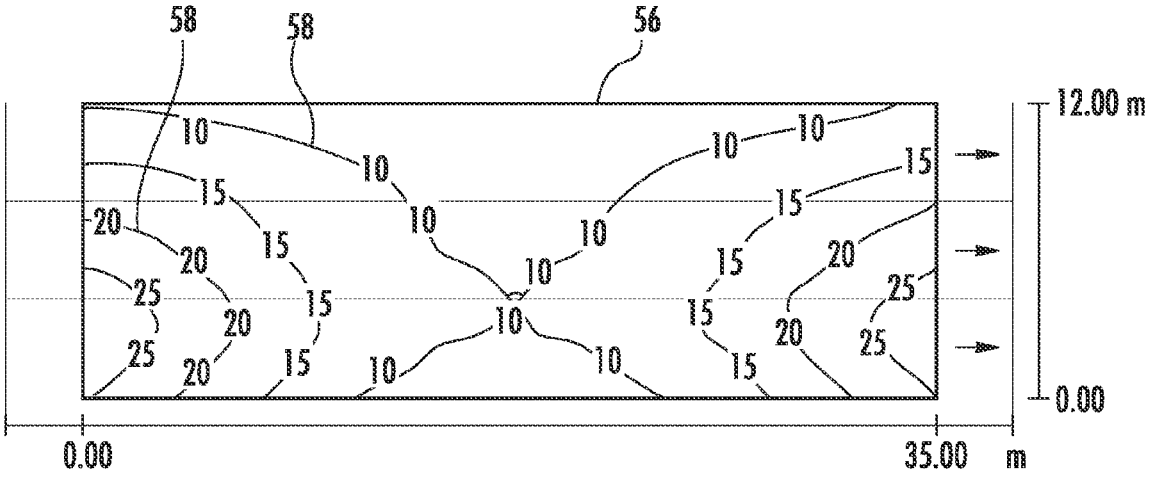
FIG. 24 is an illustration of illumination on a three-lane road surface by street lamps using the street lamp lens.

FIG. 24 shows a simulation of a three lane road 56 illuminated according to the foregoing example. Contour lines of light intensity 58 are overlaid on the road 56 for two adjacent street lamps using the secondary lens 10 according to the present example. The simulation shows the results of road illumination effects of 140-watt lamps that include the secondary optical lens of the preferred embodiment. Light is distributed in elongated areas extending along the direction of the road. The light output is efficient in that the light output of one light fixture extends to the light output of a next light fixture, and excess light is not spilled onto area outside of the roadway. The secondary lens 10 provides control of the light output of the street light fixtures.

Data for the road illumination simulation include the following.

| Grid: 12 × 9 Points | | | | |
|---|---|---|---|---|
| Average illumination [1×] | [Minimum] illumination [1×] | Maximum illumination [1×] | [Minimum] illumination/ Average illumination | [Minimum] illumination/ Maximum illumination |
| 14 | 7.49 | 28 | 0.529 | 0.265 |

Thus, there is shown and described a secondary optical lens featuring light-mixing effect and uniform color temperature, and used for multi-chip LED light source. The lens consists of the external faceted curved surface for light distribution, the concave incident face proximal to the LED side, the reflective micro-prism array face on the bottom, and the retainer feet for assembly purpose.

The secondary optical lens has its external faceted curved surface for light distribution has the following optical characteristics: It distributes the light rays emitted by LED within a wide-angle spectrum along X-X section (along the road direction) and within an asymmetrical and oblique spectrum along the Y-Y section (perpendicular to the road direction).

The secondary optical lens has its external curved surface for light distribution including many miniature facets thereon for light-mixing. All light rays outputted from each miniature facet have a very small diffusion angle of their own, and they form light patches of uniform color temperature after overlapping.

The secondary optical lens of an embodiment has an external curved surface for light distribution has an oblique axis along the Y-Y section. Its angle with the LED optical axis is δ, and δ is between 30 degrees and 70 degrees.

The secondary optical lens preferably has its concave incident face proximal to the LED side works to collect the light rays emitted by the LED and refract them onto the external curved surface for light distribution.

The secondary optical lens may include the reflective micro-prism array face on the back surface to collect stray light scattered from the external curved surface for light distribution and output the light through the curved surface for light distribution, hence increasing the efficiency of the lens.

The secondary optical lens of one embodiment has retainer feet for assembly purpose on the back. The feet are non-optical parts and may be of any shape.

The secondary optical lens may be used with a light source that is selected from single-chip LED, a multi-chip LED and a COB (chip on board) module LED light source.

The secondary optical lens may provide the light distribution from its curved outer surface 12 along the Y-Y section are as follows: The light rays emitted from point O at the center of the light-emitting face of the multi-chip LED light source are refracted by the concave incident face 11 onto the base face of curved surface 12. The base face of curved surface 12 distributes the incident light rays in an oblique manner and the axis of the emergent light rays is OT, i.e. all emergent light beams exit along the OT axis after light distribution. The angle between the refracting axis OT and the optical axis OZ is δ, and δ is between 30 degrees and 70 degrees. For the marginal light rays emitted from point Q at the center of the chip light-emitting face and crossing the rightmost side of the base face of curved face 12, the angle between the emergent marginal light rays and the optical axis OZ is α, and α is between −20 degrees and −45 degrees.

The secondary optical lens may have a distribution of a single light ray by the base face of curved surface 12 along the Y-Y section is as follows: A light ray OB emitted from point O at the center of the light-emitting face of the multi-chip LED light source is refracted by the concave incident race 11 onto paint C on the base face of the curved surface 12 and outputted as light ray CD after light distribution. Assuming that the angle between light ray OB and optical axis OZ is θ1 and the angle between the emergent light ray CD and the optical axis OZ is θ2, both θ2 and θ1 shall satisfy the following light distribution conditions:

$$\theta 2 = \tan^{-1}\left\{\left(\frac{90^\circ - \theta 1}{90^\circ + \delta}\right)[\tan(\delta) - \tan(\alpha)] + \tan(\alpha)\right\}$$

The secondary optical lens of a preferred embodiment has a light distribution principles on the base face of its curved surface 12 along the X-X section are as follows: The light rays emitted from point O at the center of the light-emitting face of the multi-chip LED light source are refracted by the concave incident face 11 onto the base face of curved surface 12. The base face of curved surface 12 distributes the incident light rays in a wide-angle spectrum. The angle of emergent light rays has a full width of 2Ψ, and 2Ψ is between 120 degrees and 155 degrees.

The secondary optical lens may have a distribution of a single light ray by the base face of curved surface 12 along the X-X section is as follows; A light ray OP emitted from point O at the center of the light-emitting face of multi-chip LED light source is refracted by the concave incident face 11 onto point Q on the base face of curved surface 12 and outputted as light ray QR after light distribution. Assuming that the angle between light ray OP and optical axis OZ is ξ1 and the angle between the emergent light ray QR and the optical axis OZ is ξ2, both ξ2 and ξ1 shall satisfy: the following light distribution conditions:

$$\xi 2 = \tan^{-1}\left[\frac{\xi 1}{90^\circ} \cdot \tan(\psi)\right]$$

The secondary optical lens of an exemplary embodiment has light-mixing facets or windows on its curved surface 12 that may take the form of a small plane, a small convex face or a small concave face. The facets generate a diffused light beam with a very small diffusion angle. The diffused light beams generate a light-mixing effect after overlapping. The overlapped light patches have uniform color temperature.

The secondary optical lens may provide light-mixing of a single facet on its curved surface 12 along the Y-Y section is as follows; Assuming that the camber line of the section of a small facet on curved surface 12 is C1-C'-C2; that the camber line has a radius of curvature of R'; and that camber line C1-C-C2 of the base face of curved surface 12 at this point has a local radius of curvature of R, camber lines C1-C'-C2 and C1-C-C2 will form a miniature false lens. The light ray emitted from point O at the center of the LED light-emitting face will generate an angle of divergence at a size of ±Δθ here after passing this false lens. The angle of divergence ±Δθ equals the numerical aperture angle of the false lens formed, and is related to the lamina's radius of curvature R' and the local radius of curvature R of the base face of curved surface 12 at this point. For Δθ, a range of 3 degrees~5 degrees is preferably selected.

The secondary optical lens of an example uses light-mixing of a single facet on its curved surface 12 along the X-X section is as follows: Assuming that the camber line of the section of a small lamina attached on curved surface 12 is Q1-Q'-Q2; that the camber line has a radius of curvature of R' and that camber line Q1-Q-Q2 of the base face of curved surface 12 at this point has a local radius of curvature of R, camber lines Q1-Q'-Q2 and –Q1-Q-Q2 will form a miniature false lens. The light rays emitted from point O at the center of the LED light-emitting face will generate an angle of divergence at a size of ±Δξ here after passing this false lens. The angle of divergence ±Δξ equals the numerical aperture angle of the false lens formed, and is related to the lamina's radius of curvature R' and the local radius of curvature R of the base face of curved surface 12 at this point. For Δξ, a range of 3 degrees~5 degrees is preferably selected.

The secondary optical lens may have a micro-prism array with reflective effects is designed at the bottom thereof. The abovementioned micro-prism may have a pyramid, a corner cube or a conical structure.

Thus, there is provided a secondary optical technology of LED (light-emitting diode) road illumination, particularly a secondary optical lens characterized by light-mixing effect and uniform color temperature, used for multi-chip LED light source. The structure of the secondary optical lens is characterized in that: The lens consists of the external laminated curved surface for light distribution, the concave incident face proximal to the LED side, the reflective micro-prism array face on the bottom, and the retainer feet for assembly purpose. The optical characteristics of the external laminated curved surface for light distribution of the lens are as follows: It distributes the light rays emitted by LED within a wide-angle spectrum along the X-X section and within a non-axisymmetric and oblique spectrum along the Y-Y section. This curved surface for light distribution has many miniature facets or windows thereon for light-mixing effect. All light rays outputted from each miniature facet have a very small diffusion angle of their own, and they form light patches of uniform color temperature upon overlapping. This curved surface has an oblique axis along the Y-Y section, and forms an angle δ with the LED optical axis: δ is between 30 degrees and 70 degrees. The concave incident face of the secondary optical lens is proximal to the LED side, and is used to collect the light rays emitted by LED and refract them onto the external curved surface for light distribution. The reflective micro-prism array face on the bottom of the secondary optical lens is used to collect stray light scattered from the external curved surface for light distribution and output them again through the curved surface for light distribution, hence increasing the efficiency of the lens. The retainer feet for assembly purpose of the secondary optical lens are non-optical parts and may be of any shape. The light sources adopted for the lens may include single-chip LED, multi-chip LED and COB module LED light source.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A lens for an LED street lamp for use with an LED light source having a primary lens, comprising:

a lens body of a secondary optical lens, the lens body having:

a curved outer surface from which light is emitted, the curved outer surface having a first perimeter portion and a second perimeter portion opposite the first perimeter portion;

a back surface opposite the curved outer surface, the back surface defining a recess for receiving the LED light source, the recess being closer to the first perimeter portion than to the second perimeter portion;

a reflective micro-prism array formed on the back surface;

the curved outer surface defining a concave surface portion at the first perimeter portion;

a plurality of facets on the curved outer surface; and a mounting structure for mounting the lens body, wherein the lens body has a longitudinal axis and a transverse axis, the lens body being shaped to provide optical characteristics to emit light from the LED light source over a wide distribution angle at a cross section along the longitudinal axis and to emit light from the LED light source over an oblique distribution angle at a cross section along the transverse axis.

2. A lens as claimed in claim 1, wherein each of the facets on the curved outer surface of the lens body is configured to output light over a narrow angle, the facets being arranged to emit light patches that overlap light emitted from other facets to provide light mixing so that a substantially uniform color temperature light is output from the secondary lens.

3. A lens as claimed in claim 1, wherein the curved outer surface of the lens body is shaped to emit light at an axis of refraction that is disposed at an angle relative to an optical axis of the light source of between 30 degrees and 70 degrees inclusive at a cross section of the lens body along the transverse axis.

4. A lens as claimed in claim 1, wherein the recess includes a surface facing the LED light source that is configured to collect light rays emitted by the LED light source and refract the light rays toward the external curved surface for light distribution.

5. A lens as claimed in claim 1, wherein the reflective micro-prism array on the back surface is configured to collect light reflected internally by the curved outer surface and to reflect the collected light toward the curved outer surface to distribution by the lens body.

6. A lens as claimed in claim 1, wherein the mounting structure includes a plurality of retainer feet extending from the back surface of the lens body, the retainer feet being non-optical elements.

7. A lens as claimed in claim 1, wherein the lens body is configured for use with at least one of the LED light sources selected from the group consisting of: a single chip LED light source, a multi-chip LED light source, and a chip-on-board module LED light source.

8. A lens as claimed in claim 1, wherein the lens body is shaped to refract light from a center of the light source so that light emitted from the lens body is emitted with an axis of refraction that is disposed at an angle of between 30 degrees and 70 degrees inclusive from an optical axis of the LED light source at a cross section along the transverse axis of the lens body, the lens body being shaped to refract light from a center of the light source so that a marginal emitted light ray is disposed at an angle of −20 degrees to −45 degrees inclusive relative to the optical axis of the light source at a cross section along the transverse axis of the lens.

9. A lens as claimed in claim 1, wherein the lens body is shaped to refract a single ray of light emitted from a center of the light source at an angle θ1 relative to the optical axis of the light source so that the ray of light is emitted from the curved outer surface at an angle of θ2 relative to the optical axis of the light source, wherein θ1 and θ2 satisfy the equation $$\theta 2 = \tan^{-1}\left\{\left(\frac{90^\circ - \theta 1}{90^\circ + \delta}\right)[\tan(\delta) - \tan(\alpha)] + \tan(\alpha)\right\},$$

wherein δ is an angle of an axis of refraction relative to the optical axis of the light source and a is an angle of a marginal light ray relative to the optical axis of the light source, at a cross section along the transverse axis of the lens.

10. A lens as claimed in claim 1, wherein the lens body is shaped to refract light from a center of the light source so that the light emitted from the lens body is distributed in an emission angle of between 120 degrees to 155 degrees inclusive at a cross section along the longitudinal axis of the lens.

11. A lens as claimed in claim 1, wherein the lens body is shaped to refract a single ray of light emitted from a center of the light source at an angle ξ1 relative to an optical axis of the light source so that the ray of light is emitted from the curved outer surface at an angle ξ2 relative the optical axis of the light source, wherein ξ1 and ξ2 satisfy the equation $$\xi 2 = \tan^{-1}\left[\frac{\xi 1}{90^\circ} \cdot \tan(\psi)\right],$$

wherein ψ is an angle of distribution of light from the lens body, at a cross section along the longitudinal axis of the lens.

12. A lens as claimed in claim 1, wherein the facets include at least one of a flat plane, a concave face, and a convex face, the facets being arranged to emit light patches that overlap light emitted from other facets to provide light mixing so that a substantially uniform color temperature light is output from the secondary lens.

13. A lens as claimed in claim 1, wherein the surface of a facet on the curved outer surface and a projection of the facet on the inner surface of the recess with reference to a center of the light source form a false lens having a divergent effect on light emitted from the facet, wherein light emitted from a center of the light source through the facet is spread by a divergent angle of approximately 3 degrees to 5 degrees inclusive, along a cross section taken along a transverse axis of the lens.

14. A lens as claimed in claim 1, wherein the surface of a facet on the curved outer surface and a projection of the facet on the inner surface of the recess with reference to a center of the light source form a false lens having a divergent effect on light emitted from the facet, wherein light emitted from a center of the light source through the facet is spread by a divergent angle of approximately 3 degrees to 5 degrees inclusive, along a cross section taken along a longitudinal axis of the lens.

15. A lens as claimed in claim 1, wherein the micro-prism array on the back surface of the lens body includes one of a pyramid reflector structure, a cube-corner reflector structure, and a conical reflector structure.

16. A method for directing light from an LED light source onto a surface, the light source defining a parallel plane that is parallel to a light emitting surface of the LED light source, comprising:

enclosing a light emitting portion of the LED light source with a first refracting surface of an optical body, disposing the first refracting surface at a substantially constant distance from the LED light source in a first perpendicular plane;

disposing the first refracting surface at a varying distance from the LED light source in a second perpendicular plane, the first and second perpendicular planes being perpendicular to one another and perpendicular to the parallel plane of the LED light source;

directing light from the LED light source into the first refracting surface of the optical body;

emitting the light from the LED light source from a second refracting surface of the optical body, the emitted light defining a refracting axis offset by an angle from the first perpendicular plane, the refracting axis of the emitted light being disposed in the second perpendicular plane, the emitted light having a greatest intensity at the refracting axis;

the emitted light including emitting the light from the LED light source in an emission pattern having a greater extent along an axis parallel to the first perpendicular plane and a lesser extent along an axis in the second perpendicular plane;

reflecting a portion of the light from the LED light source at the second refracting surface to generate first reflected light; and reflecting the first reflected light at a reflecting surface to provide a second reflected light, the second reflected light being directed toward the second refracting surface.

* * * * *